US012740685B2

(12) United States Patent
Policicchio

(10) Patent No.: US 12,740,685 B2
(45) Date of Patent: Sep. 22, 2026

(54) FLOOR CLEANING PAD

(71) Applicant: The Procter & Gamble Company, Cincinnati, OH (US)

(72) Inventor: Nicola John Policicchio, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 792 days.

(21) Appl. No.: 18/101,659

(22) Filed: Jan. 26, 2023

(65) Prior Publication Data

US 2024/0252015 A1 Aug. 1, 2024

Related U.S. Application Data

(60) Provisional application No. 63/304,331, filed on Jan. 28, 2022.

(51) Int. Cl.
*A47L 13/16* (2006.01)
*A47L 13/20* (2006.01)

(52) U.S. Cl.
CPC ..... *A47L 13/16* (2013.01); *A47L 13/20* (2013.01)

(58) Field of Classification Search
CPC ..... A47L 13/16; A47L 13/20; A47L 13/256
See application file for complete search history.

(56) References Cited

U.S. PATENT DOCUMENTS 8,060,973 B2 * 11/2011 Wildeman ..... D04H 11/00 15/228
2007/0141299 A1 6/2007 Hong
2019/0150695 A1 5/2019 Weyhmiller

FOREIGN PATENT DOCUMENTS

WO 2009082136 A1 7/2009

OTHER PUBLICATIONS

PCT Search Report and Written Opinion for PCT/US2023/061318 dated May 22, 2023,12 pages.
U.S. Appl. No. 29/825,707, filed Feb. 4, 2022, Nicola John Policicchio.
U.S. Appl. No. 29/825,118, filed Jan. 28, 2022, Nicola John Policicchio.

* cited by examiner

*Primary Examiner* — Shay Karls
(74) *Attorney, Agent, or Firm* — Gary J. Foose

(57) ABSTRACT

A cleaning pad including a floor sheet, wherein said floor sheet has at least two regions of absorbent materials including a first region having a relatively medium absorbency material and a second region, wherein the second region includes one or both of a relatively low absorbency material and a relatively high absorbency material. The first region and said second region together have a combined planar area. The first region constitutes from more than 30% to 65% of the combined planar area. The second region constitutes from 30% to less than 60% of the combined planar area. The first region and the second region form a substantially coplanar floor engaging surface.

20 Claims, 9 Drawing Sheets

FLOOR CLEANING PAD

FIELD OF THE INVENTION

Floor cleaning pad and method of using a floor cleaning pad.

BACKGROUND OF THE INVENTION

Attempts have been made to provide cleaning pads and mopping substrates that absorb liquids, such as cleaning solutions. The liquids may be absorbed from hard surfaces, such as floor and countertops. After cleaning a given area, mops require rinsing and wringing to replenish the cleaning surface. The problem associated with either dunking into bucket to pre-wet and/or rinsing to remove debris is that the mopping device becomes overly saturated. Even with action of wringing, the substrate retains an excess of liquid that reduces the ability of the substrate to absorb dirty solution off a surface such as a floor. Since everyday soils found on a typical floor comprise insoluble components such as clays and dust as well as soluble components such as lipids and salts, inadequate absorbency can lead to residue left behind either from unremoved soil and/or unremoved cleaning agents from the cleaning solution. This can often lead to noticeable streaks and haze and eventual residue build-up.

Cleaning systems that employ a ready to use detergent solution in combination with a replaceable absorbent cleaning pad, and a cleaning implement may overcome the above problems to some degree. The absorbent cleaning pad can have an absorbent capacity that is large enough to treat an appreciable surface area without the user needing to change the pad. This not only alleviates the need to rinse the cleaning pad, but it also provides the user with a more consistent cleaning since this system applies fresh cleaning solution to surface and uses a pad having a sufficient absorbent capacity.

While available cleaning systems seem to meet the cleaning needs for conventional floor types such as vinyl, ceramic and to some degree conventional wood, they fall short on a new growing segment of floors modern wood and laminates. Modern wood and laminates differ from conventional wood in that in addition to wood, they can comprise an outer surface that is made of more durable coatings. Conventional wood is typically uncoated solid wood boards typically nailed or glued down. This wood is then coated with a semi-permanent wax or polyurethane coating applied by an installer or home finisher. This coating eventually will wear off and requires stripping and application of new coating. Modern wood uses a newer technology in which the floors are factory finished so that there is not a second finishing step required after installation. The finish applied to these modern wood floors typically uses fine nano sized particles of aluminum oxide as a hardening agent. This is combined with several layers of polyurethane to give the floor lasting surface shine and durability. Laminate floors differ from wood in that they are not constructed from wood yet are designed to have a wood look and feel by using a photographic applique layer under a clear protective layer. The inner core layer is usually composed of melamine resin and fiber board materials.

Modern wood and laminate floors are in many ways more challenging to clean and care for compared to conventional floors such as vinyl and ceramic. One of the reasons for this is that these modern wood/laminate floors have a unique surface wettability profile. One way to measure surface wettability is to measure contact angle. Contact angle is the angle, conventionally measured through the liquid, where a liquid/vapor interface meets a solid surface. It quantifies the wettability of a solid surface by a liquid via the Young equation. A given system of solid, liquid, and vapor at a given temperature and pressure has a unique equilibrium contact angle. However, in practice contact angle hysteresis is observed, ranging from the so-called advancing (maximal) contact angle to the receding (minimal) contact angle. The equilibrium contact is within those values and can be calculated from them. The equilibrium contact angle reflects the relative strength of the liquid, solid, and vapor molecular interaction. Modern wood and laminates are up to three times more hydrophobic compared to a ceramic floor.

Surfaces having higher contact angles and therefore being more hydrophobic are more prone to streaking. This results from the cleaning solution after being wiped across the surface being more prone to readily de-wet and in turn drying into streaks and film. Since many wood and laminate floors also tend to be darker and shinier than conventional floors like ceramic and vinyl, the streaks and film are much more visually noticeable. Streaks and film remaining after cleaning can be further aggravated by using a small volume of cleaning solution on such floors. Manufacturers and installers of such floors typically recommend using only a small volume of cleaning solution. This often leaves users of such floors unsatisfied with the apparent cleanliness of the floor.

Important attributes of the surface of a cleaning pad that contacts flooring include absorbency, coefficient of friction, and wet collapse. Nylon, polyester, and polypropylene are common fibers that are used to fabricate cleaning pads. Nylon fibers tend to absorb about ten times more than polyester fibers, and about one-hundred times more than polypropylene fibers. Nylon tends to have a more amorphous structure compared to polyester and polypropylene, which tends to have a more crystalline structure. The hydrogen component in water tends to tightly bond with the oxygen component in nylon which drives the higher affinity of water to nylon. Furthermore, once the water is bound to nylon, the hydrogen component of free water has an affinity to bind to the oxygen component in the surface being wiped. This creates a dipole-to-dipole Van der Waals attractive force known as hydrogen bonding. This may explain why fibers having a relatively high nylon content create a higher wet co-efficient of friction than fibers comprising a relatively high polyester content. Fibers having a high polypropylene content tend to have a low coefficient of friction as compared to polyester and nylon since polypropylene has a comparatively low hydrogen bonding potential.

Cleaning pads need to have sufficient absorbency to lift the spent detergent solution and soil from the floor. If the absorbency is too low, the spent detergent solution and soil remains on the floor, which is undesirable. In consideration that cleaning pads are slid along the floor, cleaning pads that have a high coefficient of friction may not be desirable since they may be more difficult to maneuver on a floor. Maneuverability includes not only the sliding resistance but instability that may develop in the joint between the handle and the mop head to which the cleaning pad is attached due to variations in sliding resistance of different parts of the cleaning pad as the cleaning pad is moved along the floor. A decrease in sliding resistance may be accompanied by a decrease in absorbency.

Highly absorbent materials for cleaning pads can be prone to wet collapse during use. Wet collapse can decrease the spacing amongst fibers and can trap large particles and leave such particles partially exposed on the wiping surface of the cleaning pad. These trapped and partially exposed particles can generate a scraping sound when the cleaning pad is wiped on the floor and can abrade the floor. Even small particles of clay can be trapped and exposed on the wiping surface of the cleaning pad, which can cause micro abrasions of the floor which can dull the appearance of the floor. Cleaning pads that experience limited wet collapse may be able to more effectively trap large and small particles more deeply in the pad so that they do not or have limited contact with the floor. For many materials used to fabricate cleaning pads, an increase in absorbency is accompanied by an increased susceptibility to wet collapse.

In view of the above, there is a continuing unaddressed need for a cleaning pad that delivers the desirable level of absorbency, has an acceptable sliding resistance on the floor, and does not experience wet collapse to a degree that degrades performance of the cleaning pad to an unacceptable degree.

SUMMARY OF THE INVENTION

A cleaning pad (1) comprising a floor sheet (2), wherein said floor sheet comprises at least two regions (10) of absorbent materials (11) including a first region (12) comprising a relatively medium absorbency material (8) and a second region (13), wherein said second region comprises one or both of a relatively low absorbency material (7) and a relatively high absorbency material (9), wherein said relatively low absorbency material is 1.1 to 1.35 times less absorbent than said relatively medium absorbency material and said relatively high absorbency material is 1.1 to 1.35 times more absorbent than said relatively medium absorbency material, wherein said first region and said second region together have a combined planar area, wherein said first region comprises from more than 30% to 65% of said combined planar area, wherein said second region comprises from 30% to less than 60% of said combined planar area, wherein said first region and said second region form a substantially coplanar floor engaging surface (19).

A cleaning pad comprising at least three regions of absorbent materials including a first region comprising a relatively medium absorbency material, a second region comprising a relatively high absorbency material, and a third region comprising a relatively low absorbency material, wherein said relatively low absorbency material is 1.1 to 1.35 times less absorbent than said relatively medium absorbency material and said relatively high absorbency material is 1.1 to 1.35 times more absorbent than said relatively medium absorbency material, wherein said first region, said second region, and said third region have a combined surface area, wherein said first region comprises more than 10%-25 of said combined surface area, and wherein said third region comprises less than about 25-45% of said combined surface area, wherein said first region, said second region, and said third region form a substantially coplanar floor engaging surface.

DETAILED DESCRIPTION OF THE INVENTION

Figure 1:
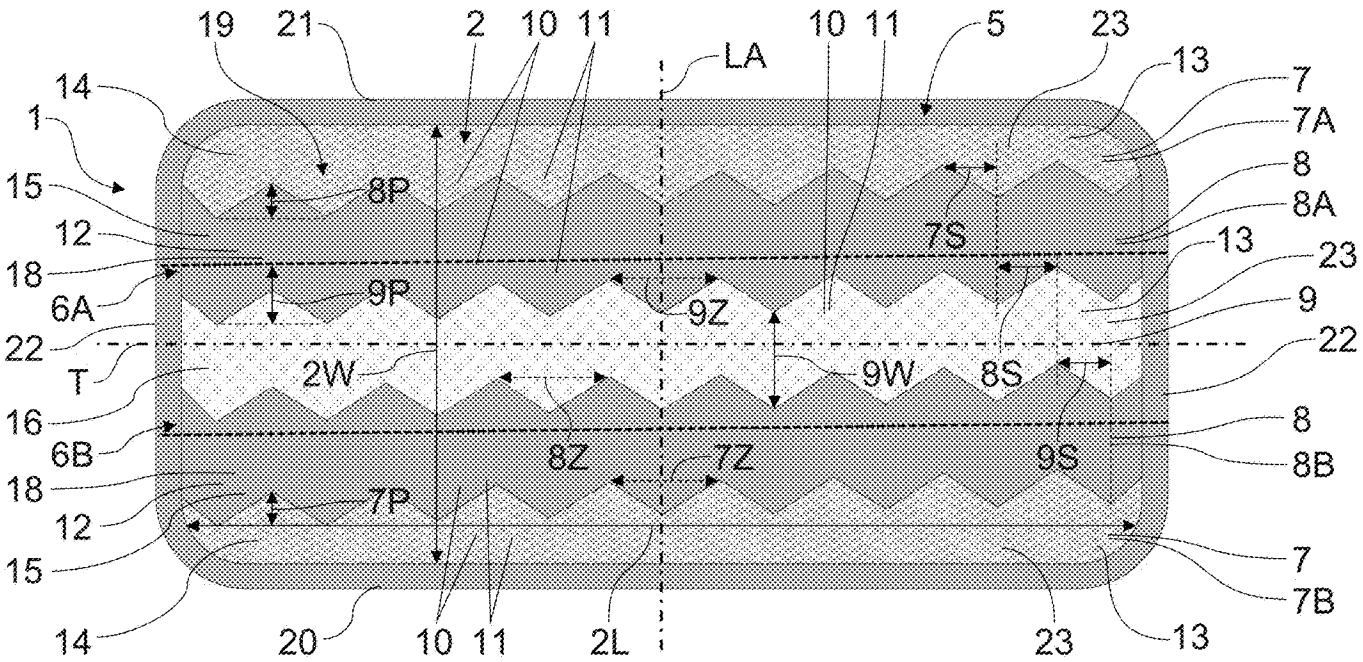
FIG. 1 is a plan view of a cleaning pad.
Figure 2:
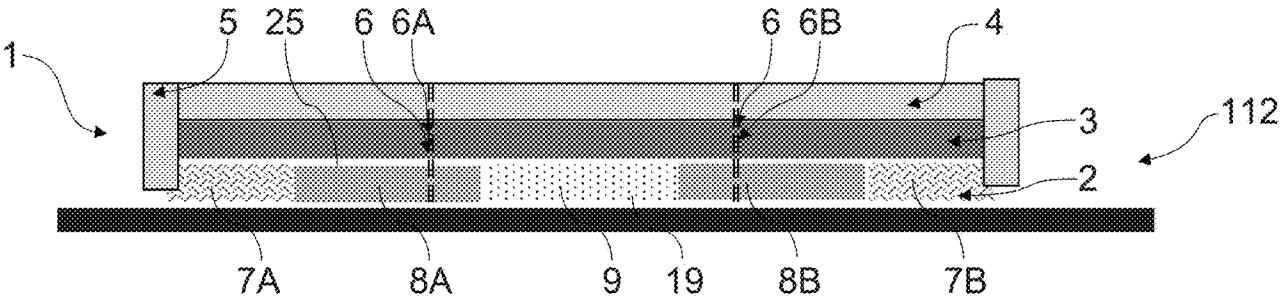
FIG. 2 is a cross sectional view of the cleaning pad of FIG. 1.

A cleaning pad 1 is shown in FIGS. 1 and 2. FIG. 1 is a plan view of cleaning pad 1 with the floor sheet 2 oriented toward the viewer. FIG. 2 is a cross sectional view along the longitudinal axis LA in a plane orthogonal to the transvers axis T. The cleaning pad 1 can have a longitudinal axis LA. The front edge 20 and a back edge 21 opposite the front edge 20. The front edge 20 and the back edge 21 can cross the longitudinal axis LA. The front edge 20 is the edge of the cleaning pad 1 oriented away from the user of the cleaning pad when the cleaning pad 1 is in the in-use position in contact with a floor 112. The cleaning pad 1 can comprise a pair of side edges 22 on opposite sides of the longitudinal axis LA connecting the front edge 20 and the back edge 21. The side edges 22 can cross the transverse axis T, the transverse axis T being perpendicular to the longitudinal axis LA.

The cleaning pad 1 can comprise a floor sheet 2. The floor sheet can comprise at least two regions 10 of absorbent materials 11 including a first region 12 and a second region 13. The first region 12 can comprise a relatively medium absorbency material 8 (8A, 8B). The second region can comprise one or both of a relatively low absorbency material 7 and a relatively high absorbency material 9. The first region 12 can be a continuous or discontinuous. Likewise, the second region 13 can be continuous or discontinuous.

To provide for a cleaning pad 1 having a desirable level of absorbency, acceptable sliding resistance on the floor, and does not experience wet collapse to a degree that degrades performance of the cleaning pad 1 to an unacceptable degree, it can be desirable to provide a plurality of regions of the absorbent materials that differ from one another in absorbency and make up different percentages of the combined planar area of the first region 12 and second region 13. The relative comparison of absorbency of the first region 12 and the material or materials constituting the second region 13 in combination with the fraction of the planar area of the first region 12 and second region 13 as compared to the combined planar area of the first region 12 and the second region 13 can be important characteristics to balance to provide a highly performing cleaning pad 1.

The absorbency and planar area of the relatively medium absorbency material 8 (8A, 8B) can be the material upon which the relatively low absorbency material 7 (7A, 7B) and relatively high absorbency material 9 are comparatively characterized based on relative absorbency and planar area. The relatively low absorbency material 7 (7A, 7B) can be from 1.1. to 1.35 times less absorbent than the relatively medium absorbency material 8 (8A, 8B). The relatively high absorbency material 9 can be 1.1 to 1.35 times more absorbent than the relative medium absorbency material 8

(8A, 8B). Optionally, the relatively low absorbency material 7 can be 1.15 to 1.3 time less absorbent than the relatively medium absorbency material 8 (8A, 8B). Optionally, the relatively high absorbency material 9 can be 1.15 to 1.3 times more absorbent than the relatively medium absorbency material 8 (8A, 8B).

The first region 12 and the second region 13 can have combined planar area. Planar area is the quantity that provides a measure of the extent of a two-dimensional shape in the plane. The first region 12 can comprise from more than 30% to 65%, optionally from more than 35% to 60%, optionally from more than 40% to 55%, of the combined planar area. The second region 13 can comprise from 30% to less than 60%, optionally from 35% to less than 55%, optionally from 40% to less than 50%, of the combined planar area. Together, the first region 12 and the second region 13 can form a substantially coplanar floor engaging surface 19. The first region 12 can comprise from more than 40% to 60% of the combined planar area. Optionally, the second region 13 can comprise from 35% to less than 50% of the combined planar area.

The cleaning pad 1 can comprise a floor sheet 2, a back sheet 4, and a core 3 between the floor sheet 2 and the back sheet 4. The floor sheet 2 has a floor engaging surface 19 and an opposing core facing surface, the core facing surface 25 being oriented towards the core 3. The floor sheet 2, core 3, and back sheet 4 can be joined to one another by binding 5, stitching 6 (6A, 6B), adhesive, or other suitable structure for joining lamina.

The absorbency of the materials is based on the weight of de-ionized water absorbed by the material after it has been placed in a water bath for a predetermined period for soak and predetermined time to allow free solution drainage to achieve equilibrated state for absorbency. A portion of material having a planar area of at least 1 $cm^2$ is selected and removed from a specific region of the floor sheet 2 and the area is recorded. The portion is equilibrated for 24 hours in a controlled temperature and humidity environment set to 20 C 45% relative humidity. After equilibration, the portion is removed from the controlled temperature and humidity environment and within 2 minutes is weighed to determine the equilibrated weight and then submerged in in 20 C deionized water and allowed to soak for 10 minutes. After 10 minutes, the portion is removed from the deionized water, suspended, and allowed to freely drain for 1 minute in a controlled temperature and humidity environment set to 20 C 45% relative humidity. After freely draining for 1 minute, the portion is weighed within one minute to determine the wet weight of the portion. The difference between the wet weight of the portion and the equilibrated weight of the portion is computed. The absorbency is computed as that difference divided by the planar area of the portion. Absorbency is reported in grams per square centimeter.

The back sheet 4 of the cleaning pad 1 may be a unitary sheet of fabric that may be made from cotton, wool, or a synthetic fiber such as nylon, or other backing material. The back sheet 4 can be 100% polyester. The purpose of the back sheet 4 is to provide the cleaning pad 1 with thickness and enable attachment to the head of a mop device for pushing the cleaning pad 1 over the floor 112. The back sheet 4 can have a basis weight from about 50 $g/m^2$ to about 250 $g/m^2$, optionally about 100 $g/m^2$ to about 200 $g/m^2$. The back sheet 4 can have a thickness from about 0.2 mm to about 2 mm, optionally from about 0.5 mm to about 1 mm. The total thickness of the floor sheet 2, core 3, and back sheet 4 can be from about 2 mm to about 10 mm, optionally from about 2 mm to about 7 mm.

The core 3 of the cleaning pad 1 may be one or more unitary sheets of substrates that may be made from cotton, rayon, cellulose, wool, or man-made fibers such as nylon, polyester or blends thereof. The core 3 can be a polyurethane foam or other foam. The purpose of the core 3 is to provide the cleaning pad 1 with thickness that may provide cushioning which may help to reduce the potential for the cleaning pad 1 to damage the floor 112, may improve the structural integrity of the cleaning pad 1 during use and washing of the cleaning pad 1, and may provide for wicking of liquid through the floor sheet 2 from the floor 112.

The floor sheet 2 can have a generally rectangular shape having a length 2L and a width 2W. Around the perimeter, perimeter binding 5 can be provided. Perimeter binding 5 can be stitching, wrapped fabric or other bonding means connecting the floor sheet 2 with back sheet 4 at the abutting edges thereof. The core 3 can optionally also be fixed within the perimeter binding 5. The structural integrity of the cleaning pad 1 can be further enhanced by stitching 6 (6A, 6B) positioned in approximately the middle third of the pad across the longitudinal axis LA, and optionally substantially parallel to the transverse axis T. The stitching 6 (6A, 6B) can connect the floor sheet 2, optional core 3, and optional back sheet 4.

The floor sheet 2 can be composed of multiple laterally extending, parallel portions of material that may be sewn or otherwise connected at the abutting edges thereof in one step using textile weaving equipment. In the example embodiment shown in FIGS. 1 and 2, the floor sheet 2 is formed by two outer portions 14 of relatively low absorbency material 7 (7A, 7B), two intermediate portions 15 of relatively medium absorbency material 8 (8A, 8B) and one central portion 16 of relatively high absorbency material 9. These various portions can be strips of absorbent material.

The first region 12 and second region 13, and strips of absorbent materials constituting those regions, can be textiles having a basis weight from about 200 grams per square meter to about 1000 grams per square meter, optionally from about 400 grams per square meter to about 800 grams per square meter. The basis weights of the regions and strips of absorbent materials can differ from one another by less than 50%, optionally less than 30%. Using the same or similar enough basis weight material for the different regions and strips constituting the regions can help provide for enough fibers to contact the floor surface 112, help to provide for a substantially coplanar floor engaging surface 19, help to provide for similar elasticity and compressibility amongst the different regions and strips, The relatively low absorbency material 7 (7A, 7B) can be selected from the group of 100% polyester twisted loop microfiber material, 2 denier 100% polyester one ply material, blended polyester and polypropylene fibers material. The relatively low absorbency material 7 (7A, 7B) can be the same material as employed as the dark blue material that forms the outer strips of the—BONA MICROFIBER CLEANING PAD.

The relatively high absorbency material 9 can be selected from the group of cut pile microfiber, 80:20 polyester:nylon blend microfiber material in untwisted configuration, 80:20 polyester:nylon three ply material, rayon, cotton, and cellulose-based regenerated fibers such as cotton, rayon from bamboo, lyocell, modal, and silk blend with cotton. The relatively high absorbency material 8 can be the same material as employed as the light blue material that forms the central strip of the BONA MICROFIBER CLEANING PAD.

The relatively medium absorbency material 8 (8A, 8B) can be selected from the group of 60:40 polyester:nylon microfiber blend in a twisted loop microfiber configuration, 70:30 polyester:nylon microfiber blend in a twisted loop microfiber configuration, 80:20 polyester:nylon microfiber blend in a twisted loop microfiber configuration, 85:15 polyester:nylon microfiber blend in a twisted loop microfiber configuration, 90:10 polyester:nylon microfiber blend in a twisted loop microfiber configuration, and 95:5 polyester:nylon microfiber blend in a twisted loop microfiber configuration, and combinations thereof. The relatively medium absorbency material 8 (8A, 8B) can be a 60:40 to 95:5 polyester:nylon microfiber blend in a twisted loop microfiber configuration.

In FIGS. 1 and 2, the first region 12 can be the relatively medium absorbency material 8 (8A, 8B). The second region 13 can be the relatively low absorbency material 7 (7A, 7B) and relatively high absorbency material 9. The two outer portions 14 of floor sheet 2 can comprise relatively low absorbency material 7 (7A, 7B) and can comprise from 25% to 35% of the combined planar area of the floor sheet 2. The central portion 16 is positioned centrally along the longitudinal axis LA and can comprise relatively high absorbency material 9 and can comprise from 25% to 35% of the combined planar area of the floor sheet. Together, the relatively low absorbency material 7 (7A, 7B) and the relatively high absorbency material 9 can constitute the second region 13. The two intermediate portions 15 of floor sheet 2, positioned inward of the two outer portions 14, can comprise relatively medium absorbency material 8 (8A, 8B) and can comprise from more than 30% to 65% of the combined planar area of the floor sheet 2. The first region 12 and the second region 13 can form a substantially coplanar floor engaging surface 19.

The first region 12 can comprise at least two spaced apart first region strips 18 extending across the longitudinal axis LA. The first region strips 18 can be separated from one another by at least part or parts of the second region 13. The second region 13 can comprise three spaced apart second region strips 23. The second region 23 can extend across the longitudinal axis LA. The second region strips 23 can extend across the longitudinal axis LA. Each of the first region strips 18 can be between two second region strips 23. In the arrangement shown in FIGS. 1 and 2, the relatively high absorbency material 9 in the central portion 16 is part of the second region 13. The other part of the second region 13 can be the relatively low absorbency material 7 (7A, 7B) in the outer portions 14 of the floor sheet 2. Optionally, at least one second region strip 23 can be between two first region strips 18 and the at least one second region strip 23 can be chevron shaped.

The first region strips 18 can be chevron shaped. The chevrons can be shaped such that the relatively low absorbency material peak height 7P, relatively medium absorbency material peak height 8P, and relatively high absorbency material peak height 9P are from about 5 mm to about 35 mm, optionally from about 10 mm to about 25 mm. The relatively low absorbency material peak-to-peak width 7Z, relatively medium absorbency material peak-to-peak width 8Z, and relative high absorbency material peak-to-peak width 9Z can be from about 5 mm to about 50 mm, optionally from about 15 mm to about 35 mm.

The chevron shapes of the first region strips 18 can be in phase with one another, optionally out of phase with one another. The peak that is formed at the intersection the outer portions 14 abutting respective intermediate portions 15, can be in line with (in the longitudinal direction) the corresponding peak that is formed at the intersection the intermediate portions 15 and the central portion 16. The peaks between the outer portions 14 and the respective intermediate portions 15 relative to the peaks between the intermediate portions 15 and the central portion 16 can be staggered. The dimensions for the amount of stagger 7S, 8S, and 9S can be from about 5 mm to about 35 mm, optionally from about 10 mm to about 25 mm.

The first region 12 and second region 13 can form a pattern of interlocking chevron shapes. Without being bound by theory, it is possible that the chevron shapes are advantageous in that they may act to funnel and concentrate the debris being picked up by the floor sheet 2 into the portion that ultimately collects that debris. Further, the chevron shapes may help the user observe the type of debris being collected so that they can better understand what the sources of debris in their household are so that they can emphasize certain aspects of cleanliness.

The floor sheet 2 can comprise three different absorbency portions in a five strip configuration, central portion 16 flanked along the longitudinal axis LA by two abutting intermediate portions 15, the intermediate portions 15 being outwardly flanked along the longitudinal axis LA by two abutting outer portions 14. In FIGS. 1 and 2, the absorbency of the materials increases from the front edge 20 and back edge 21 to central portion 16. Optionally, the relatively high absorbency material 9 could be positioned in the outer portions 14 and the relatively low absorbency material 7 could be positioned in the central portion 16. The three different absorbency materials, relatively low absorbency material 7, relatively medium absorbency material 8, and relatively high absorbency material 9, could be alternated to position the materials in different positions. For example, the absorbency gradient could be reversed to provide relatively low absorbency material 7 in the central portion 16, relatively medium absorbency material 8 in the intermediate portions 15, and relatively high absorbency material 9 in the outer portions 14. Optionally, the three different absorbency materials could be arranged so that the relatively medium absorbency material 8 is in the central portion 16, the relatively high absorbency material 9 is in the intermediate portions 15, and the relatively low absorbency material 7 is in the outer portions 14. Optionally, one second region strip 23 can comprise the relatively high absorbency material 9 and extend along the transverse axis T and two second regions strips 23 can be on opposite sides of the transverse axis and comprise the relatively low absorbency material 7 and be spaced apart from the relatively high absorbency material 9. The second region strip 23 of relatively high absorbency material 9 along the transverse axis T can between two spaced apart first region strips 18 of relatively medium absorbency material 8. Optionally the first region can comprise from more than 40% to 60% of the combined planar area. The second region strip 23 comprising the relatively high absorbency material 9 can comprise less than 30%, optionally from about 5% to less than 30%, of the combined planar area and the second region strips 23 comprising the relatively low absorbency material 7 can comprise less than 30%, optionally from about 5% to less than 30%, of the combined planar area.

The different portions of the cleaning pad 1 can optionally have colors that differ from one another so that the user can identify the differing performing portions. For example, central portion 16, which can comprise the relatively high absorbency material 9 can have a lightest color shade, the intermediate portions 15 can have a darkest color shade, and the outer portions 14 can have a shade between the lightest color shade and the darkest color shade. The color shades can be Pantones in purple shade of varying degree of color intensity. For example, the color shades can be Pantone 365C, a Medium purple dye 2587C, and dark purple dye Pantone 3535C.

Figure 3:
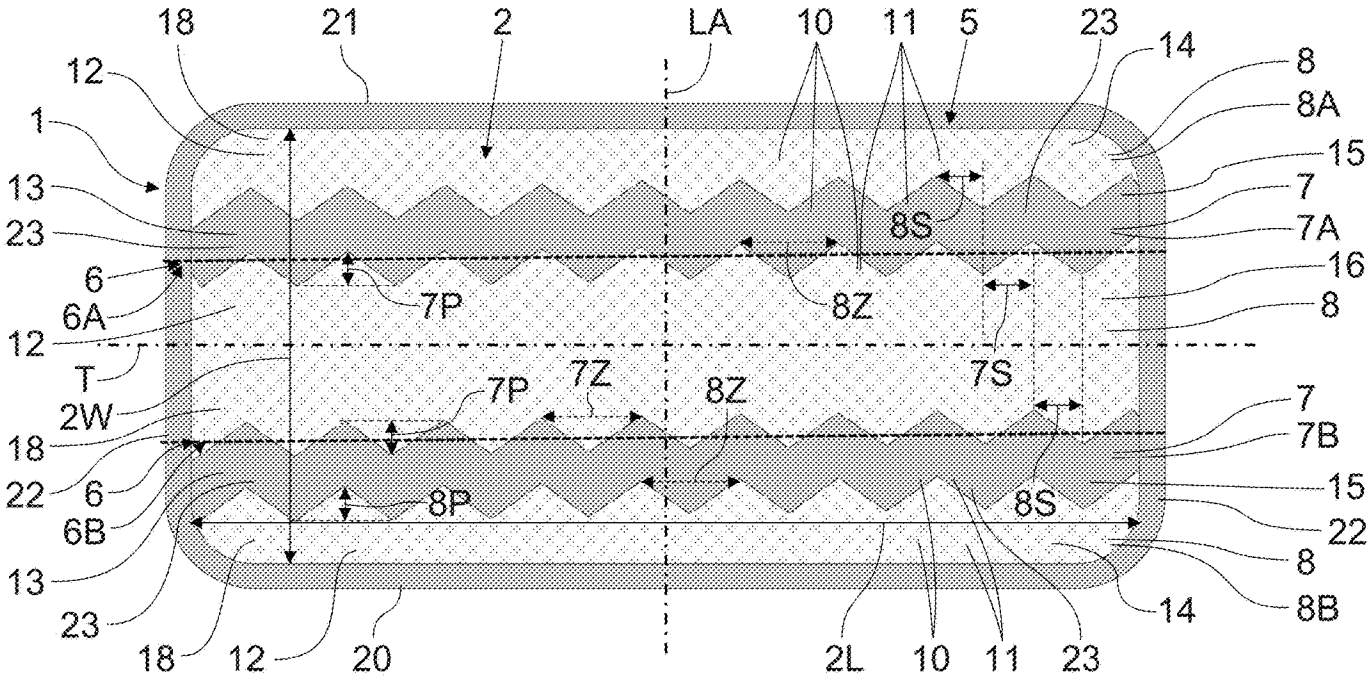
FIG. 3 is a plan view of a cleaning pad.
Figure 4:
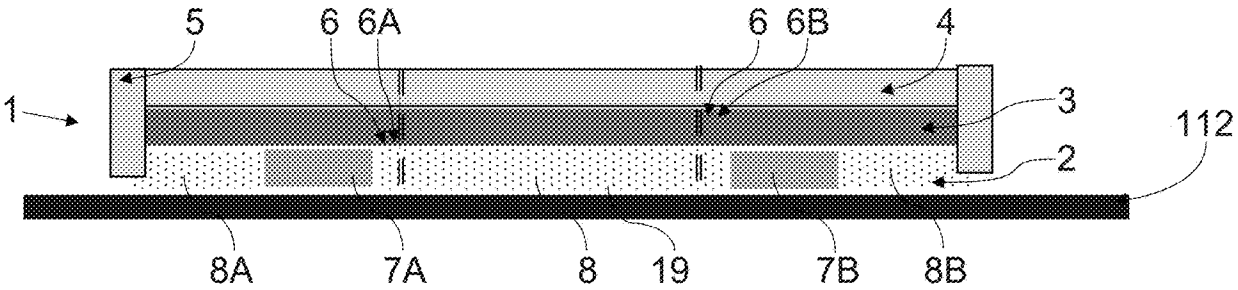
FIG. 4 is a cross sectional view of the cleaning pad of FIG. 3.

The cleaning pad 1 can be as illustrated in FIGS. 3 and 4. FIG. 3 is a plan view of cleaning pad 1 with the floor sheet 2 oriented toward the viewer. FIG. 4 is a cross sectional view along the longitudinal axis LA in a plane orthogonal to the transvers axis T. The floor sheet 2 can be formed by two outer portions 14 of relatively medium absorbency material 8 (8A, 8B), two intermediate portions 16 of relatively low absorbency material 7 (7A, 7B) and one center portion 15 of relatively medium absorbency material 8. These various portions can be strips of absorbent material.

In FIGS. 3 and 4 the first region 12 can be the relatively medium absorbency material 8 (8A, 8B). The second region 13 can be the relatively low absorbency material 7 (7A, 7B). The first region 12 can comprise three spaced apart first region strips 18 extending across the longitudinal axis LA. The first region strips 18 can be separated from one another by at least parts of the second region 13. The second region 13 can comprise at least two spaced apart second region strips 23 extending across the longitudinal axis LA. In the arrangement shown in FIGS. 3 and 4, the relatively low absorbency material 7 (7A, 7B) in the intermediate portions 15 constitutes the second region 13. The two intermediate portions 15, which are the second region strips 23, together constitute the second region 13, even though they are spaced apart from one another. Each second region strip 23 can be between two first region strips 18. The first region 12 can comprise from more than 30% to 65% of the combined planar area. The second region 13 can comprise from 30% to less than 60% of the combined planar area. Together, the first region 12 and the second region 13 can form a substantially coplanar floor engaging surface 19. The two outer portions 14 of floor sheet 2 can comprise relatively medium absorbency material 8 (8A, 8B) and can comprise 15% to 30% of the combined planar area of the floor sheet 2. The central portion 16 is positioned centrally along the longitudinal axis LA and can comprise relatively medium absorbency material 8 and can comprise 15% to 30% of the combined planar area of the floor sheet. The two intermediate portions 15 of cleaning floor sheet 2, positioned inward of the two outer portions 14, can comprise relatively low absorbency material 7 (7A, 7B) and can comprise from 30% to less than 60% of the combined planar area of the floor sheet 2.

The second region strips 23 can be chevron shaped. The chevrons can be shaped such that the relatively medium absorbency material peak height 8P and relatively low absorbency material peak height 7P are from about 5 mm to about 35 mm, optionally from about 10 mm to about 25 mm. The relatively medium absorbency material peak-to-peak width 8Z and relatively low absorbency material peak-to-peak width 7Z can be from about 5 mm to about 50 mm, optionally from about 15 mm to about 35 mm.

The chevron shapes of the second region strips 23 can be in phase with one another, optionally out of phase with one another. The peak that is formed at the intersection of the outer portions 14 abutting respective intermediate portions 15, can be directly in line with (in the longitudinal direction) the corresponding peak that is formed at the intersection the intermediate portions 15 and the central portion 16. The peaks between the outer portions 14 and the respective intermediate portions 15 relative to the peaks between the intermediate portions 15 and the central portion 16 can be staggered. The dimensions for the amount of stagger 7S and 8S can be from about 5 mm to about 35 mm, optionally from about 10 mm to about 25 mm.

The cleaning pad 1 can comprise two different absorbency zones in a five strip configuration, central portion 16 flanked along the longitudinal axis LA by two abutting intermediate portions 15, the intermediate portions being flanked along the longitudinal axis LA by two abutting outer portions 14. In FIGS. 3 and 4, the absorbency of the materials alternates from between medium absorbency material 8 and low absorbency material 7, from the front edge 20 or back edge 21 towards the central portion 16. Optionally, the relatively low absorbency material 7 could be positioned in the outer portions 14 and the central portion 16 and the relatively medium absorbency material 8 could be positioned in the intermediate portions 15.

Figure 5:
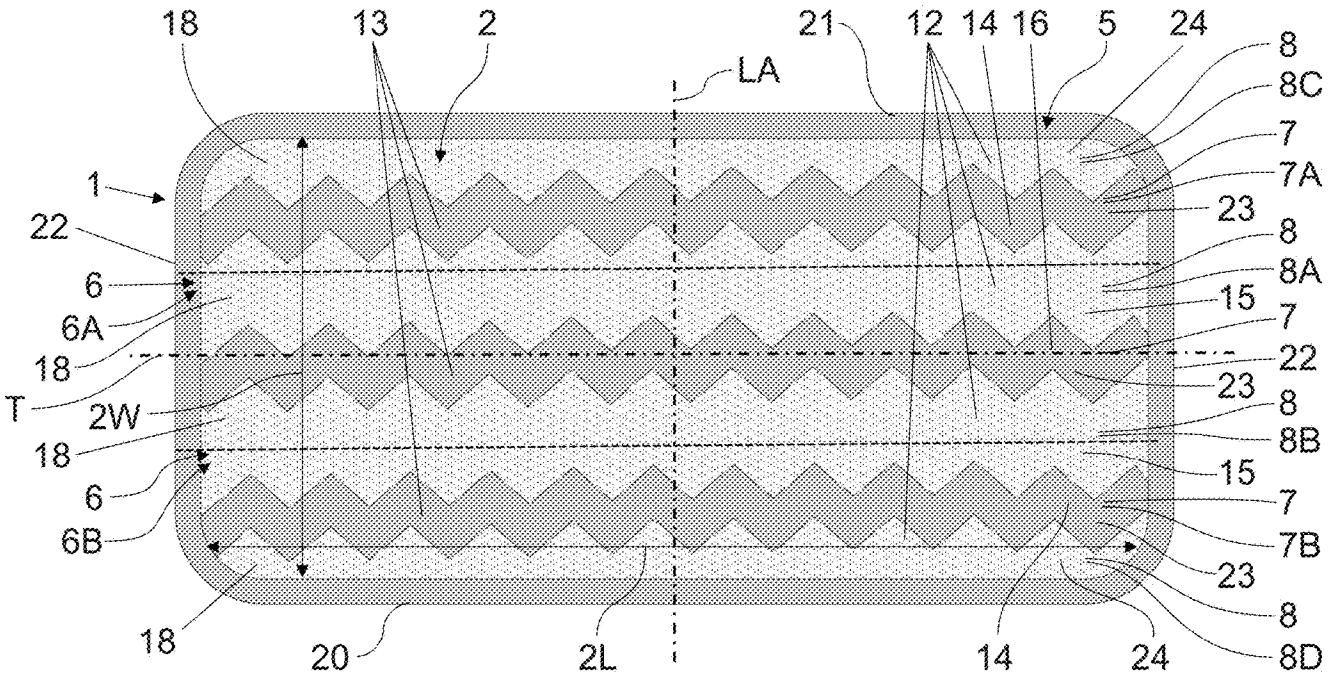
FIG. 5 is a plan view of a cleaning pad.
Figure 6:
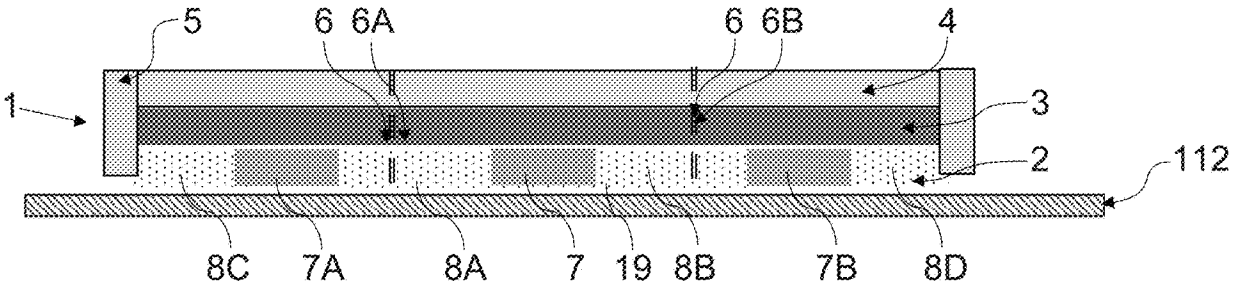
FIG. 6 is a cross sectional view of the cleaning pad of FIG. 5.

The cleaning pad 1 can be as illustrated in FIGS. 5 and 6. The floor sheet 2 is formed by two extended portions 24 of relatively medium absorbency material 8 (8C, 8D), two outer portions 14 of relatively low absorbency material 7 (7A, 7B), two intermediate portions 16 of relatively medium absorbency material 8 (8A, 8B), and one central portion 15 of relatively low absorbency material 7. These various portions can be strips of absorbent material.

In FIGS. 5 and 6 the first region 12 can be the relatively medium absorbency material 8 (8A, 8B, 8C, 8D). The second region 13 can be the relatively low absorbency material 7 (7, 7A, 7B). The first region 12 can comprise four spaced apart first region strips 18 extending across the longitudinal axis LA. The first region strips 18 can be separated from one another by at least parts of the second region 13. The second region 13 can comprise three spaced apart second region strips 23. In the arrangement shown in FIGS. 5 and 6, the relatively medium absorbency material 8 (8A, 8B) in the intermediate portions 15 and extended portions 24 (medium absorbency material 8, 8C, 8D) constitute the first region 12. The central portion 16 and two outer portions 14, which are the second region strips 23, together constitute the second region 13, even though they are space apart from one another. The first region 12 can comprise from more than 30% to 65% of the combined planar area. The second region 13 can comprise from 30% to less than 60% of the combined planar area. Together, the first region 12 and the second region 13 can form a substantially coplanar floor engaging surface 19. The two extend portions 24 can comprise relatively medium absorbency material 8 (8C, 8D) and can comprise 10% to 15% of the combined planar area of the floor sheet. The two outer portions 14 of floor sheet 2 can comprise relatively low absorbency material 7 (7A, 7B) and can comprise 10% to 15% of the combined planar area of the floor sheet 2. The two intermediation portions 15 can comprise relatively medium absorbency material 8 (8A, 8B) and can comprise 10% to 15% of the combined planar area of the floor sheet. The central portion 16 is positioned centrally along the longitudinal axis LA and can comprise relatively low absorbency material 7 and can comprise 10% to 15% of the combined planar area of the floor sheet.

The second region 13 can comprise three spaced apart second region strips 23 extending across the longitudinal axis LA. One of the second region strips 23 can extend along the transverse axis T. The first region 12 can comprise two first region strips 18 on opposite sides of the transverse axis T and be separated by the second region strip 23 that extends along the transverse axis T. The first region strips 18 can between two second region strips 23. Optionally, the first region 12 can comprise three spaced apart first region strips 18 extending across the longitudinal axis LA. One of the first region strips 18 can extend along the transverse axis T. The second region can comprise two second region strips 23 on opposite sides of the transverse axis T and be separated from one another by a first region strip 18 that extends along the transverse axis T.

The second region strips 23 can be chevron shaped. The chevron shapes of the second region strips 23 can be in phase with one another, optionally out of phase with one another. The peak that is formed at the intersection of the outer portions 14 abutting respective intermediate portions 15 can be in line with (in the longitudinal direction) the corresponding peak that is formed at the intersection the intermediate portions 15 and the central portion 16. The peaks between the outer portions 14 and the respective intermediate portions 15 relative to the peaks between the intermediate portions 15 and the central portion 16 can be staggered.

The cleaning pad 1 can comprise two different absorbency zones in a seven strip configuration, central portion 16 flanked along the longitudinal axis LA by two abutting intermediate portions 15, the intermediate portions being flanked along the longitudinal axis LA by two abutting outer portions 14, and the outer portions 14 being flanked by two abutting extended portions 24, by way of nonlimiting example as shown in FIGS. 5 and 6. FIG. 5 is a plan view of cleaning pad 1 with the floor sheet 2 oriented toward the viewer. FIG. 6 is a cross sectional view along the longitudinal axis LA in a plane orthogonal to the transvers axis T. In FIGS. 5 and 6, the absorbency of the materials alternates from the between medium absorbency material 8 and low absorbency material 7, from the front edge 20 or back edge 21. Optionally, the relatively low absorbency material 7 could be positioned in the extended portions 24 and the intermediate portions 15 and the relatively medium absorbency material 8 could be positioned in the outer portions 14 and central portion 16.

A prior art cleaning pad 1 and six inventive examples are set forth in Table 1.

TABLE 1

A prior art cleaning pad and four inventive examples.

| Prior Art (A) | — | Number of Intermediate Portions | Central Portion | | Relative Absorbency Ratio Central Portion:Intermediate Portion | |
|---|---|---|---|---|---|---|
| Portion | (no outer portions since there are only three strips of material) | 2 | 1 | — | — | — |
| % of Combined Planar Area | — | 44% (22% each portion) | 56% | — | — | — |
| Type of Material | — | 100% polyester twisted loop microfiber (relatively low absorbency) | 80:20 polyester:nylon untwisted microfiber (relatively high absorbency) | — | — | — |
| Absorbency g/cm$^2$ | — | 0.208 | 0.311 | — | — | — |
| Relative Absorbency Ratio | — | — | — | — | 1.50 | — |

| Inventive Example 1 | Number of Outer Portions | Number of Intermediate Portions | Central Portion | Relative Absorbency Ratio Intermediate Portion:Outer Portion | Relative Absorbency Ratio Intermediate Portion:Central Portion | Relative Absorbency Ratio Central Portion:Outer Portion |
|---|---|---|---|---|---|---|
| Portions | 2 | 2 | 1 | — | — | — |
| % of Combined Planar Area | 32% (16% each strip) | 48% (24% each strip) | 20% | — | — | — |
| Type of Material | 100% polyester twisted loop microfiber (relatively low absorbency) | 80:20 polyester:nylon untwisted microfiber (relatively high absorbency) | 80:20 polyester:nylon twisted loop microfiber (relatively medium absorbency) | — | — | — |
| Absorbency g/cm$^2$ | 0.215 | 0.316 | 0.266 | — | — | — |
| Relative Absorbency Ratio | — | — | — | 1.47 | 1.19 | 1.24 |

| Inventive Example 2 | Number of Outer Portions | Number of Intermediate Portions | Central Portion | Relative Absorbency Ratio Intermediate Portion:Outer Portion | Relative Absorbency Ratio Intermediate Portion:Central Portion | Relative Absorbency Ratio Central Portion:Outer Portion |
|---|---|---|---|---|---|---|
| Portions | 2 | 2 | 1 | — | — | — |
| % of Combined Planar Area | 40% (20% each strip) | 40% (20% each strip) | 20% | — | — | — |

TABLE 1-continued

A prior art cleaning pad and four inventive examples.

| | | | | | | |
|---|---|---|---|---|---|---|
| Type of Material | 80:20 polyester:nylon twisted loop microfiber (relatively medium absorbency) | 80:20 polyester:nylon untwisted microfiber (relatively high absorbency) | 80:20 polyester:nylon twisted loop microfiber (relatively medium absorbency) | — | — | — |
| Absorbency g/cm$^2$ | 0.273 | 0.335 | 0.270 | — | — | — |
| Relative Absorbency Ratio | — | — | — | 1.23 | 1.24 | 0.99 |

| Inventive Example 3 | Number of Outer Portions | Number of Intermediate Portions | Central Portion | Relative Absorbency Ratio Outer Portion: Intermediate Portion | Relative Absorbency Ratio Central Portion:Intermediate Portion | Relative Absorbency Ratio Central Portion:Outer Portion |
|---|---|---|---|---|---|---|
| Portions | 2 | 2 | 1 | — | — | — |
| % of Combined Planar Area | 38% (19% each strip) | 44% (22% each strip) | 18% | — | — | — |
| Type of Material | 80:20 polyester:nylon untwisted microfiber (relatively high absorbency) | 80:20 polyester:nylon twisted loop microfiber (relatively medium absorbency) | 80:20 polyester:nylon untwisted microfiber (relatively high absorbency) | — | — | — |
| Absorbency g/cm$^2$ | 0.335 | 0.273 | 0.330 | — | — | — |
| Relative Absorbency Ratio | — | — | — | 1.23 | 1.21 | 0.99 |

| Inventive Example 4 | Number of Outer Portions | Number of Intermediate Portions | Central Portion | Relative Absorbency Ratio Intermediate Portion:Outer Portion | Relative Absorbency Ratio Central Portion:Intermediate Portion | Relative Absorbency Ratio Central Portion:Outer Portion |
|---|---|---|---|---|---|---|
| Portions | 2 | 2 | 1 | — | — | — |
| % of Combined Planar Area | 32% (16% each strip) | 46% (23% each strip) | 22% | — | — | — |
| Type of Material | 100% polyester twisted loop microfiber (relatively low absorbency) | 80:20 polyester:nylon twisted loop microfiber (relatively medium absorbency) | 80:20 polyester:nylon untwisted microfiber (relatively high absorbency) | — | — | — |
| Absorbency g/cm$^2$ | 0.214 | 0.266 | 0.325 | — | — | — |
| Relative Absorbency Ratio | — | — | — | 1.24 | 1.22 | 1.52 |

(A) BONA MICROFIBER CLEANING PAD

Notes:

For Inventive Examples 1-4, average of low relative absorbency material absorbency = 0.21 g/cm$^2$, average medium relative absorbency material absorbency = 0.26 g/cm$^2$, and average of high absorbency material absorbency = 0.32 g/cm$^2$.

Figure 7:
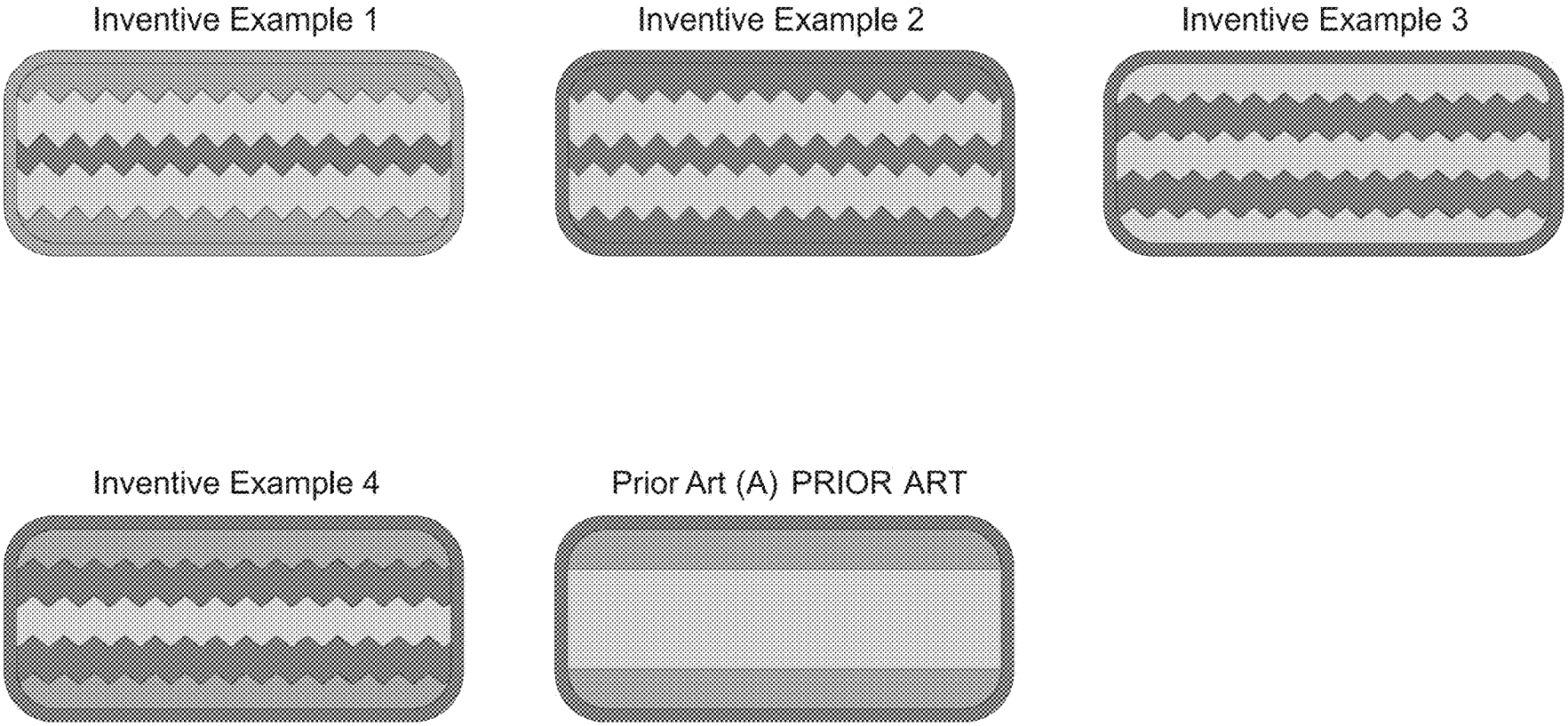
FIG. 7 are images of Inventive Examples 1-4 and Prior Art (A).

The prior art cleaning pad and inventive examples in Table 1, and shown in FIG. 7 were evaluated by a consumer panel of 100 persons and results are listed in Table 2. Cleaning pads 1 that employ chevron shaped patterns in combination with using alternating light and darker colors between portions creates surprisingly better consumer perception for appearance and cleaning compared to Prior Art (A). Without being bound by theory, it is believed that there is a threshold between the ratio of light to dark colors that may impact user perception. Furthermore, if the lighter color is applied to relatively high absorbency material, using a fraction of planar area of this combination on the floor sheet may create a negative perception of cleaning performance and extended life durability. Relatively high absorbency material that is 80:20 polyester:nylon blend microfiber material in an untwisted configuration may be technically more prone to flattening and or collapsing over extended use. However, the fibers may also feel and look softer, with lighter color possibly being associated with increased softness. As shown in Table 2, the lowest ratings in consumer perceptions are for the Prior Art (A) cleaning pad 1 and Inventive Example 3. In both of these cleaning pads, the cleaning pad comprises of 80:20 polyester:nylon untwisted microfiber in the lightest shade of color at about 60% of the combined planar area. In contrast, for the best performing Inventive Example 4, the floor sheet comprises of 80:20 polyester:nylon untwisted microfiber in the lightest shade of color at only 30% of the combined planar area. Well regarded cleaning pads may comprise at least two different types of fibers, wherein one of the types of fibers is a relatively medium absorbency material and the ratio of light shade to dark shade colors is less than about 60% light shade to greater than about 40% dark shades, and optionally less than 40% light shade to greater than 60% dark shade. Optionally, the cleaning pad may be comprised of at least two different types of fibers wherein one of those fibers is a relatively medium absorbency material, and the cleaning pad has three different shades of color: light, medium and dark, wherein the light shade comprises less than about 40% of the combined planar area, medium shade comprises greater than about 30% of the combined planar area and dark shade comprises greater than about 30% of the combined planar area. Optionally, different hues could be employed in place of different shades.

TABLE 2

Consumer perceptions of a prior art cleaning pad and four inventive examples.

| | Inventive Example 1 | Inventive Example 2 | Inventive Example 3 | Inventive Example 4 | Prior Art (A) |
|---|---|---|---|---|---|
| Outer Portions | 100% polyester twisted loop microfiber (low relative absorbency) (medium shade) | 80:20 polyester:nylon twisted loop microfiber (medium relative absorbency) (dark shade) | 80:20 polyester:nylon untwisted microfiber (high relative absorbency) (light shade) | 100% polyester twisted loop microfiber (low relative absorbency) (medium shade) | — |
| Intermediate Portions | 80:20 polyester:nylon untwisted microfiber (high relative absorbency) (light shade) | 80:20 polyester:nylon untwisted microfiber (high relative absorbency) (light shade) | 80:20 polyester:nylon twisted loop microfiber (medium relative absorbency) (dark shade) | 80:20 polyester:nylon twisted loop microfiber (medium relative absorbency) (dark shade) | 100% polyester twisted loop microfiber (low relative absorbency) (light shade) |
| Central Portion | 80:20 polyester:nylon twisted loop microfiber (medium relative absorbency) (dark shade) | 80:20 polyester:nylon twisted loop microfiber (medium relative absorbency) (dark shade) | 80:20 polyester:nylon untwisted microfiber (high relative absorbency) (light shade) | 80:20 polyester:nylon untwisted microfiber (high relative absorbency) (light shade) | 80:20 polyester:nylon untwisted microfiber (high relative absorbency) (light shade) |
| Overall Rating | 73 | 74 | 70 | 81 | 65 |
| Cleaning | 71 | 76 | 68 | 74 | 68 |
| Durability | 77 | 74 | 67 | 85 | 73 |
| Overall Appearance | | | | | |
| Rank 1st | 5 | 5 | 14 | 71 | 5 |
| Rank 2nd | 29 | 24 | 24 | 5 | 18 |
| Rank 3rd | 33 | 43 | 5 | 14 | 5 |
| Rank 4th | 19 | 14 | 52 | 10 | 5 |
| Rank 5th | 14 | 14 | 5 | 5 | 67 |
| Overall Cleaning | | | | | |
| Rank 1st | 10 | 4 | 28 | 48 | 10 |
| Rank 2nd | 38 | 5 | 24 | 14 | 19 |
| Rank 3rd | 10 | 57 | 5 | 14 | 14 |
| Rank 4th | 24 | 19 | 38 | 19 | 0 |
| Rank 5th | 19 | 14 | 5 | 5 | 57 |

(A) BONA MICROFIBER CLEANING PAD

Figure 8:
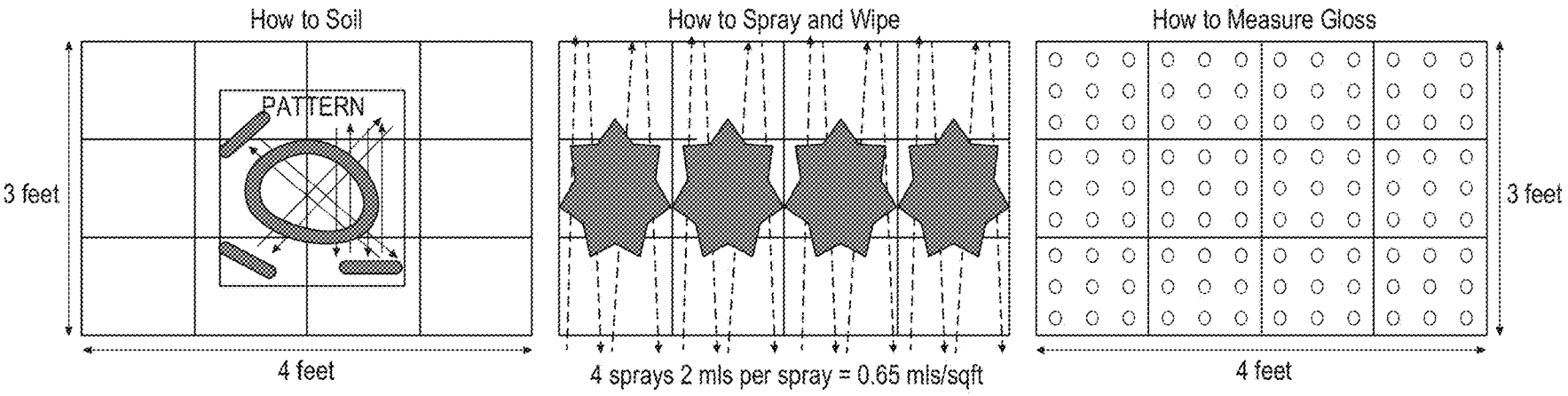
FIG. 8 is a schematic of the test setup for cleaning tests.

To demonstrate the advantages of using fibers having relatively medium absorbency in combination with fibers with relatively high absorbency, or in combination with fibers of relatively low absorbency or in combination with both fibers having relatively high absorbency and fibers having relatively low absorbency, a series of cleaning tests were performed. The test setup is illustrated in FIG. 8. The floor used for testing was distributed by Home Legend (11875 Cabernet Dr., Fontana, CA) under reference RN 104577 Santos Mahogany engineered hardwood plank size 4 and 19 mm wide by 9.5 mm thick. Floors were laid down into 914 mm wide by 1219 mm long sections. Nine sections of flooring were soiled and evaluated for cleaning performance. Floors were evaluated for streaks using 0 to 4 scale (0 is none, 1 is slight, 2 is moderate, 3 is severe and 4 is extreme), for film using 0 to 4 scale (0 is none, 1 is slight, 2 is moderate, 3 is severe and 4 is extreme) and for delta gloss using BYK Gardner gloss meter (measure of amount of gloss (shine) loss between gloss for unsoiled floor compared to cleaned floor (measures soil and chemistry residue left behind)). In addition to cleaning, the cleaning pads were tested for multi cycle kinetic wet coefficient of friction using deionized water. The testing was conducted using a cut portion of the cleaning pad with the entire floor sheet contacting a wetted surface with the cleaning pad attached to a weighted block. After applying 0.5 ml increments of deionized water directly to surface, the weighted cleaning pad was pulled across the floor surface using a cable attached to a force gauge and the peak force was recorded. This was repeated twenty times with average wet coefficient of friction reported.

The procedure for the cleaning tests illustrated in FIG. 8 was as follows:

1. Set up tiles in sets of 3×4=12 sq ft.
2. Clean tiles with diluted Dawn dish soap & water. Rinse thoroughly. Lay tiles on flat surface wipe dry with Bounty.
3. Then apply solution 30:70 DH20/IPA to cover tile and remove with squeegee. Allow to air dry.
4. Using BKY Gardner gloss meter (or equivalent), record gloss (60-degree setting) at 9 points per each sq ft. Record for all floor sets.
5. Mix a soil solution comprising of 19.7 g of sieved Vacuum cleaner soil (sieved through <75 um sieve)+ 4.85 g of Canola Oil+700 g of IPA. Add water to make 1000 g solution (% dry soil solids=2.5%). Make sure liquid soil remains constantly stirring to avoid settling of particulates.

6. Using 10 ml pipette draw 8 ml from middle of beaker and Apply soil directly to bottom 4 center tiles in about 12 inches circle (0.2 g/ft dry soil).
7. Wipe immediately using primed roller in criss-cross followed by up & down (24 strokes) until soil spread even across 4 sq feet of tile (increase pressure on roller as needed to spread). Allow to dry at least 30 minutes
8. Weigh dry pad a record as initial weight in grams. Weigh container with solution and record initial weight.
9. Spray onto soiled area as shown in diagram. Dose 4 sprays ~8 grams solution=0.65 mL per sq ft).
10. Wipe up & down 12 strokes left to right & additional 12 strokes right to left on Floor Set 1. Repeat for each 4×3 until 9 floor sections cleaned. Place pad in labeled bag and seal to avoid dry out as pad may be used for multiple cycle testing.
11. Re-weigh pad and subtract from initial dry pad weight. Re-weigh bottle+solution to determine total solution dispensed.
12. Divide amount of solution absorbed by pad from amount of total solution dispensed, multiply by 100 and record as Absorbent Efficiency.
13. Allow to dry and grade streaks and film separately using 0 to 4 scale 0 none 4 is severe. Record average grade from 9 floor tests.
14. Using Gardner gloss meter at 60 degree setting record 9 gloss readings per sq ft as same points measured prior to cleaning. Record average. This represents final gloss. Subtract final gloss from initial gloss to determine delta gloss loss Results of cleaning and wet coefficient of friction tests comparing inventive cleaning pads and a prior art cleaning pad are shown in Table 3. All cleaning pads were tested on same mopping device using same wetting solution. The SWIFFER WETJET device and solution was used in this testing.

TABLE 3

Results of cleaning and coefficient of friction tests comparing inventive cleaning pads and a prior art cleaning pad.

| | Inventive Example 1 | Inventive Example 2 | Inventive Example 3 | Inventive Example 4 | Prior Art (A) |
|---|---|---|---|---|---|
| Streaks-0 to 4 (lower is better) | 0.7 | 0.5 | 0.4 | 0.4 | 0.9 |
| Film-0 to 4 (lower is better) | 0.8 | 0.6 | 0.4 | 0.2 | 1.2 |

TABLE 3-continued

Results of cleaning and coefficient of friction tests comparing inventive cleaning pads and a prior art cleaning pad.

| | Inventive Example 1 | Inventive Example 2 | Inventive Example 3 | Inventive Example 4 | Prior Art (A) |
|---|---|---|---|---|---|
| Delta Gloss (lower is better) | 4.6 | 3.7 | 2.8 | 3.1 | 8.2 |
| Absorbent Efficiency (g) | 38 | 48 | 50 | 45 | 42 |
| Wet Coefficient of Friction-water (g) | 0.7 | 1 | 0.95 | 0.75 | 0.7 |

(A) BONA MICROFIBER CLEANING PAD

Without being bound by theory, it is thought that cleaning pads having a coefficient of friction similar to Prior Art (A) can be provided by employing relatively medium absorbency materials. Surprisingly, employing relatively medium absorbency materials can improve measures of cleaning performance of the cleaning pads, the measures including streaks, film, and gloss, as shown in Table 3. Surprisingly, this improved cleaning performance can be achieved while maintaining an acceptable wet coefficient of friction. In use, Inventive Examples 2-4 were perceived as not requiring an excessive amount of force to drive the cleaning pad over the surface being cleaned.

Without being bound by theory, it is thought that improved cleaning benefits can be attributed to relatively medium absorbency materials being better than relatively high absorbency materials at resisting flattening/fiber collapse during use. To evaluate fiber collapse resistance, a series of technical tests were conducted comparing relatively low absorbency material, relatively medium absorbency material, and relatively high absorbency material. The tests consisted of removing the floor sheet from a cleaning pad, then cutting a specified section from a portion that was previously determined to comprise relatively low absorbency material, relatively medium absorbency material, or relatively high absorbency material. The specific section was then measured for initial dry thickness using a caliper instrument. Measurements were taken at several points across the strip and averaged. 0.1 ml/cm$^2$ of water was applied to the section of the strip evenly across the entire strip. After the water penetrated strip, a weight that covered the entire strip was applied over the strip and the weight per unit area was 35 g/cm$^2$. The weight was applied for two minutes and then removed. After five minutes, which allowed some time for the wet strip to rebound to some degree, a weight per unit area of 35 g/cm$^2$ was applied and the caliper was measured again. The final wet caliper was divided by initial dry thickness and recorded as percent caliper recovered. For each material, three replicate measures of percent caliper recovered were made. Results are shown in Table 4.

TABLE 4

Percent caliper recovered.

| Prior Art (A) | Outer Portions | Intermediate Portions | Central Portion |
|---|---|---|---|
| Portions | — | 2 | 1 |
| Percent of combined planar area | — | 44% (22% each portion) | 56% |
| Type of Material | | 100% polyester twisted loop microfiber (relatively low absorbency) | 80:20 polyester:nylon untwisted microfiber (relatively high absorbency) |

TABLE 4-continued

| Percent caliper recovered. | | | |
|---|---|---|---|
| % Caliper Recovered at 35 g/cm$^2$ | — | 97 | 82 |
| Inventive Example 1 | Outer Portions | Intermediate Portions | Central Portion |
| Portions | 2 | 2 | 1 |
| Percent of combined planar area | 32% (16% each strip) | 48% (24% each strip) | 20% |
| Type of Material | 100% polyester twisted loop microfiber (relatively low absorbency) | 80:20 polyester:nylon untwisted microfiber (relatively high absorbency) | 80:20 polyester:nylon twisted loop microfiber (relatively medium absorbency) |
| % Caliper Recovered at 35 g/cm$^2$ | 97 | 83 | 88 |

(A) BONA MICROFIBER CLEANING PAD

As shown in Table 4, for Prior Art (A), the relatively high absorbency material has a lower percent caliper recovered compared to the relatively low absorbency material. For Inventive Example 1, the relatively high absorbency material had a lower percent caliper recovered than the relatively low absorbency material. Surprisingly, the relatively medium absorbency material, which differs from the relatively high absorbency material in that microfibers are untwisted rather than twisted, has a greater percent caliper recovered than the relatively high absorbency material. As such, it is thought that the twisted microfibers provide for a more resilient structure than untwisted microfibers.

While relatively medium absorbency materials are less resistant to wet collapse compared to relatively low absorbency materials, relatively medium absorbency material may be superior to relatively low absorbency materials based on an increased absorbing ability which provides better cleaning by picking up more spent cleaning solution. Relatively medium absorbency materials may also deliver multiple advantages compared to relatively high absorbency materials: such materials may have a lower wet coefficient of friction while delivering good absorbency; such materials may be better at maintaining caliper during use; and such materials may be better able to trap particles in the interstitial spaces between microfibers away from the surface of the floor.

While not wishing to be limited by theory, it is believed that by alternating relatively medium absorbency material and relatively high absorbency material in a four or more strip design that the floor sheet is acceptable for both wet coefficient of friction and resisting wet fiber collapse. Optionally, the floor sheet can be comprised of at least four strips wherein each abutting strip alternates the type of fiber used and wherein at least two non-abutting strips comprise relatively medium absorbency material over from more than 30% to 65% of the combined planar area and the remaining non-abutting strips of relatively high absorbency material comprise from 30% to less than 60% of the combined planar area and wherein the relatively medium absorbency material has an absorbency ratio about 1.1 times to 1.35 times lower compared to the relatively high absorbency material. Optionally, the floor sheet can comprise a 5-strip design wherein the outer portions and central portion are comprised of relatively medium absorbency material over from more than 30% to 65% of the combined planar area and the and intermediate portions of relatively high absorbency material comprise from 30% to less than 60% of the combined planar area and wherein the relatively medium absorbency material has absorbency ratio of about 1.15 times to 1.3 times lower than the relatively high absorbency material.

Inventive Example 4 is like Inventive Example 3 but the relatively high absorbency material in outer portions is replaced with relatively low absorbency material. When comparing Inventive Example 4 to Inventive Example 1, the level of relatively medium absorbency material in Inventive Example 4 is more than double that in Example 4 (46% versus 20% of the combined planar area) and the level of relatively high absorbency material is about half that in Example 1 (22% vs 48% of the combined planar area). Surprisingly, Inventive Example 4 has a wet coefficient of friction close to Inventive Example 1 and Prior Art (A) and provides outstanding cleaning similar to Inventive Examples 2 and 3 which have a higher wet coefficient of friction.

Figure 9:
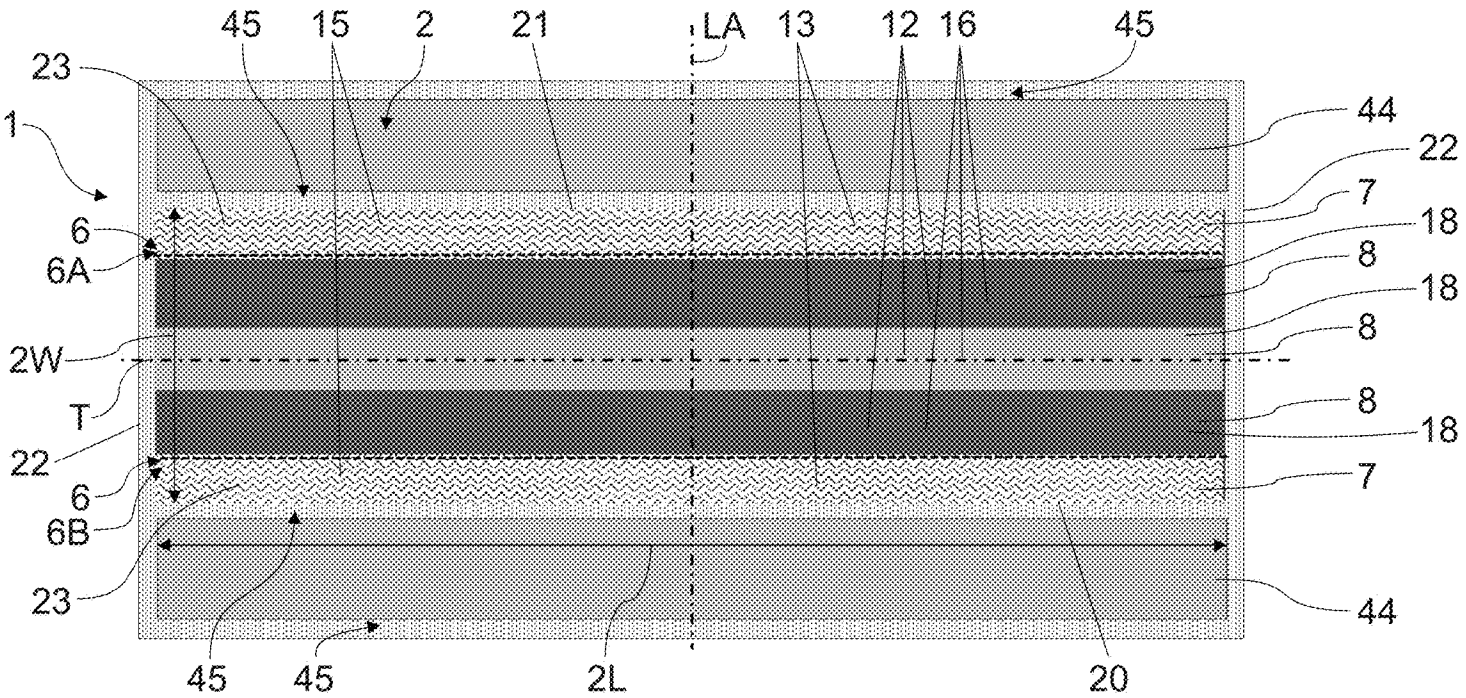
FIG. 9 is a plan view of a cleaning pad.
Figure 10:
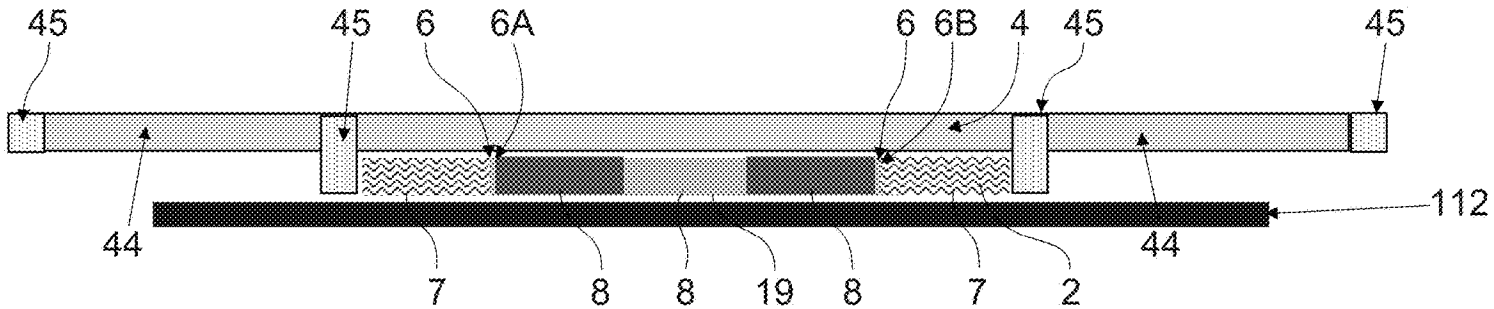
FIG. 10 is a cross sectional view of the cleaning pad of FIG. 9.

The cleaning pad 1 can be as illustrated in FIGS. 9 and 10. FIG. 9 is a plan view of cleaning pad 1 with the floor sheet 2 oriented toward the viewer. FIG. 10 is a cross sectional view along the longitudinal axis LA in a plane orthogonal to the transvers axis T. The floor sheet 2 can comprise two different absorbency regions. The first region 12 can be the relatively medium absorbency material 8. The second region 13 can be the relatively low absorbency material 7. The floor sheet 2 can comprise a central portion 16 flanked along the longitudinal axis LA by two abutting intermediate portions 15. The central portion 16 can comprise relatively medium absorbency material 8. The intermediate portions 15 can comprise relatively low absorbency material 7. Part of the central portion 16 can have a light shade of color so that soil picked up by central portion 16 may be visible to the user as an indication of function of the cleaning pad 1, for example as illustrate din FIG. 9. The light shade of color can constitute from about 15% to about 30% of the combined planar area. Likewise, part of the central portion 16 can have a dark shade of color so that heavier soils such as hair and lint are visible when retained on the floor sheet 2.

The central portion 16 can constitute the first region 12. The two abutting intermediate portions 15 can constitute the second region 13. The first region 12 can comprise from more than 30% to 65% of the combined planar area. The second region 13 can comprise from 30% to less than 60% of the combined planar area. Together, the first region 12 and the second region 13 can form a substantially coplanar floor engaging surface 19. The second region 13 can comprise two spaced apart second region strips 23 extending across the longitudinal axis LA and the second region strips 23 can be separated by at least part of the first region 12. The second region strips 23 can comprise from more than 30% to about 45% of the combined planar area. Each individual second region strip 23 can comprise from more than 15% to about 22.5% of the combined planar area. The first region 12, can comprise from more than 30% to about 45% of the combined planar area.

Optionally, the back sheet 4 can include a pair of wings 44 and binding 45. The wings 44 can extend away from the front edge 20 and the back edge 21 along the longitudinal axis L in a direction away from the transverse axis T. The binding 45 can be positioned at the distal ends of the wings 44 along the longitudinal axis L. The binding 45 can be a sewed binding. The wings 44 can be colored. The wings 44 can have a color of dark green, for example Pantone 361C. The bindings 45 can have a color that contrasts with the color of the wings 44. This can help the user identify portions of the back sheet 4 that may be connected to a mopping device. The bindings 45 can have a color of dark blue, for example Pantone 2747C. The wings 44 and or binding 45 can be sized and dimensioned to engage with a mop device.

Figure 11:
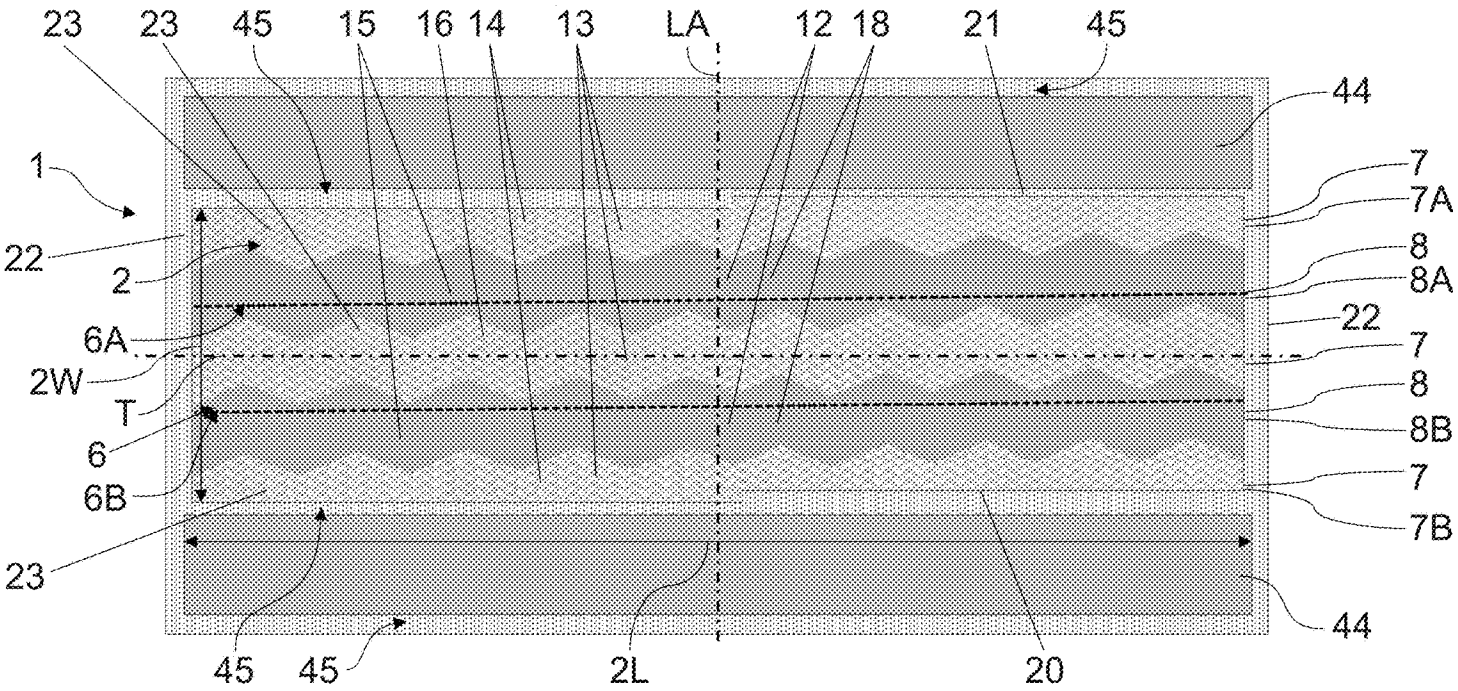
FIG. 11 is a plan view of a cleaning pad.
Figure 12:
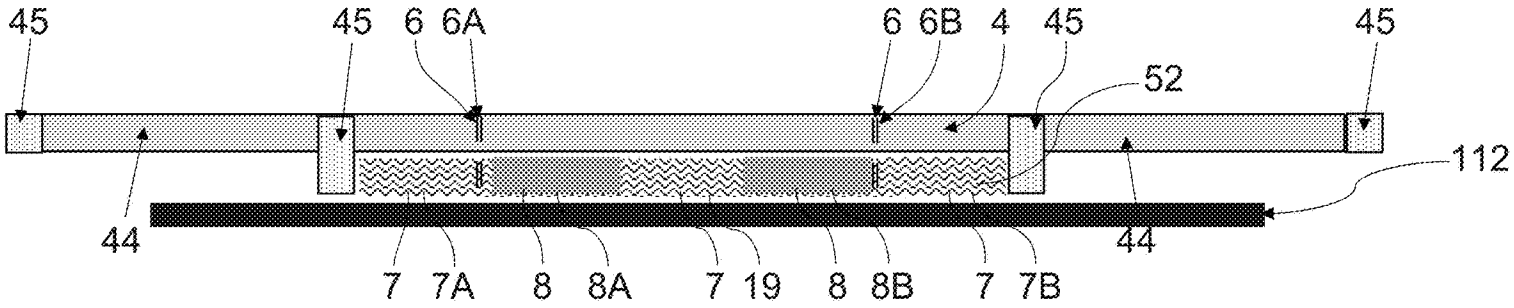
FIG. 12 is a cross sectional view of the cleaning pad of FIG. 11.

The cleaning pad 1 can be as shown in FIGS. 11 and 12. FIG. 11 is a plan view of cleaning pad 1 with the floor sheet 2 oriented toward the viewer. FIG. 12 is a cross sectional view along the longitudinal axis LA in a plane orthogonal to the transvers axis T. The floor sheet 2 can comprise two different absorbency regions. The first region 12 can be the relatively medium absorbency material 8. The second region 13 can be the relatively low absorbency material 7 (7, 7A, 7B). The floor sheet 2 can comprise a central portion 16 flanked along the longitudinal axis LA by two abutting intermediate portions 15. The central portion 16 can comprise relatively low absorbency material 7. The intermediate portions 15 can comprise relatively medium absorbency material 8 (8A, 8B). The floor sheet 2 can comprise outer portions 14. The intermediate portions 15 can be flanked by the outer portions 14. The colors of the various portions can alternate in color. For example, the medium absorbency material 8 (8A, 8B) can have a first color and the low absorbency material 7 (7A, 7B) can have a second color, the second color differing from the first color. Alternating colors of the various materials can provide a signal to the user that the cleaning pad 1 is functioning in that different colors of dust, dirt, hair, and other materials collected by the cleaning pad 1 can be visible against the colors of different backgrounds. Thus, it is likely that at least some of the material collected by the cleaning pad 1 is visible to the user on at least one absorbent material.

The first region 12 can comprise from more than 30% to 65% of the combined planar area. The second region 13 can comprise from 30% to less than 60% of the combined planar area. Together, the first region 12 and the second region 13 can form a substantially coplanar floor engaging surface 19. The second region 13 can comprise three spaced apart second region strips 23 extending across the longitudinal axis LA and the second region strips 23 can be separated by at least part of the first region 12. Each individual second region strip 23 can comprise from more than 15% to about 22.5% of the combined planar area. The first region 12, can comprise from more than 30% to about 45% of the combined planar area.

Figure 13:
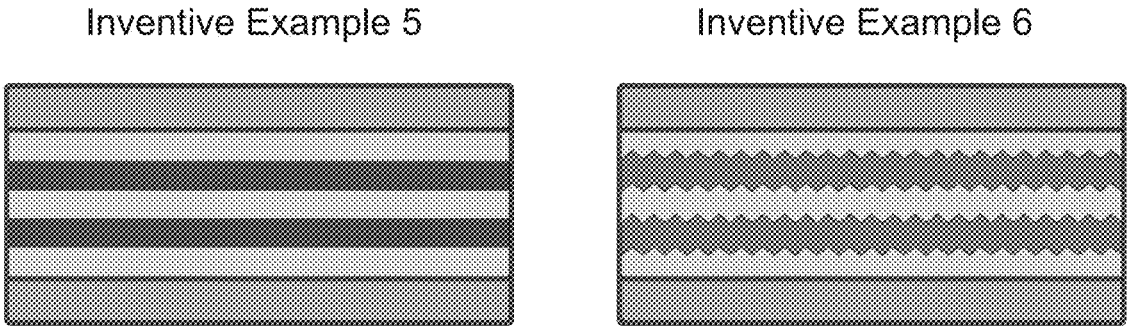
FIG. 13 are images of Inventive Examples 5 and 6.

A series of tests were conducted to evaluate cleaning pads under in-use conditions. The tests followed the same procedures as described previously with the exception that different mop devices were employed and the BONA MULTI-SURFACE cleaning solution was employed. For Inventive Examples 5 and 6 and Example 7, the mop device to which the cleaning pad was attached was a SWIFFER XL SWEEPER. The Prior Art (A) cleaning pad was attached to a BONA PREMIUM MICROFIBER MOP. The constructions of the Inventive Examples 5 and 6 are described in Table 5. Images of Inventive Examples 5 and 6 are shown in FIG. 13.

TABLE 5

Two inventive examples.

| Inventive Example 5 | Outer Portions | Intermediate Portions | Central Portion | Relative Absorbency Ratio Central Portion: Outer Portion | Relative Absorbency Ratio Central Portion:Intermediate Portion | Relative Absorbency Ratio Central Portion: Outer Portion |
|---|---|---|---|---|---|---|
| Portions | — | 2 | 1 | — | — | — |
| % of Combined Planar Area | — | 44% (22% each strip) | 56% | — | — | — |
| Type of Material | — | 100% polyester twisted loop microfiber (relatively low absorbency) | 80:20 polyester:nylon twisted loop microfiber (relatively medium absorbency) | — | — | — |
| Absorbency $g/cm^2$ | — | 0.190 | 0.237 | — | — | — |
| Relative Absorbency Ratio | — | — | — | — | 1.25 | — |

| Inventive Example 6 | Outer Portions | Intermediate Portions | Central Portion | Relative Absorbency Ratio Intermediate Portion:Outer Portion | Relative Absorbency Ratio Intermediate Portion:Central Portion | Relative Absorbency Ratio Outer Portion: Central Portion |
|---|---|---|---|---|---|---|
| Portions | 2 | 2 | 1 | — | — | — |
| % of Combined Planar Area | 38% (19% each strip) | 44% (22% each strip) | 18% | — | — | — |
| Type of Material | 100% polyester twisted loop | 80:20 polyester:nylon | 100% polyester twisted loop | — | — | — |

TABLE 5-continued

| Two inventive examples. | | | | | | |
|---|---|---|---|---|---|---|
| | microfiber (relatively low absorbency) | twisted loop microfiber (relatively medium absorbency) | microfiber (relatively low absorbency) | | | |
| Absorbency $g/cm^2$ | 0.204 | 0.236 | 0.197 | — | — | — |
| Relative Absorbency Ratio | — | — | — | 1.16 | 1.20 | 1.04 |

Notes:
For Inventive Examples 5 and 6, average of low relative absorbency material absorbency = 0.21 $g/cm^2$, average medium relative absorbency material absorbency = 0.26 $g/cm^2$.

As shown in Table 6, Inventive Examples 5 and 6 have a lower wet coefficient of friction as compared to Prior Art (A) and achieve superior cleaning as compared to Prior Art (A). A lower wet coefficient of friction may provide for improved maneuverability and stability during mopping.

TABLE 6

Results of cleaning and coefficient of friction tests comparing Inventive Examples 5 and 6, and a prior art cleaning pad.

| | Inventive Example 5 | Inventive Example 6 | Prior Art (A) |
|---|---|---|---|
| Streaks-0 to 4 (lower is better) | 2.1 | 1.8 | 2.5 |
| Film-0 to 4 (lower is better) | 0.7 | 1.3 | 1.5 |
| Delta Gloss (lower is better) | 10.9 | 8.9 | 14 |
| Absorbent Efficiency (g) | 42 | 45 | 40 |
| Wet Coefficient of Friction-water (g). | 0.62 | 0.53 | 0.7 |

(A) BONA MICROFIBER CLEANING PAD

As shown in Table 6, providing relatively medium absorbency materials, like in Inventive Examples 5 and 6, can improve cleaning performance and have a relatively low wet coefficient of friction.

Inventive Example 6 and Prior Art (A) cleaning pads were evaluated by a consumer panel and results are listed in Table 7. Notably, Inventive Example 6 was preferred over Prior Art (A) for maneuverability, contact with floor, and directional control. Employing relatively medium absorbency material, as in Inventive Example 6, provides for low wet coefficient of friction and perceived ease of use when used with a relatively light mop device. Moreover, it is thought that by alternating strips of relatively low absorbency with strips of relatively medium absorbency, that the potential for wet collapse of the materials is reduced, which can improve cleaning performance.

TABLE 7

Consumer perceptions of prior art cleaning pad and inventive example.

| | Inventive Example 6 | Prior Art (A) | No Preference | Inventive Example 6-Prior Art (A) |
|---|---|---|---|---|
| Overall System Preference | 59% | 37% | 4% | 22 |

TABLE 7-continued

Consumer perceptions of prior art cleaning pad and inventive example.

| | Inventive Example 6 | Prior Art (A) | No Preference | Inventive Example 6-Prior Art (A) |
|---|---|---|---|---|
| Overall Pad Preference | 59% | 35% | 7% | 24 |
| Cleaning/Removing soils effectively | 54% | 28% | 17% | 26 |
| Leaving surfaces streak free | 30% | 17% | 52% | 13 |
| Leaving surfaces shiny | 26% | 24% | 50% | 2 |
| Leaving surfaces free of stickiness/residue | 33% | 15% | 52% | 17 |
| Easy to maneuver the mop while cleaning | 48% | 33% | 20% | 15 |
| Mop staying in contact with the floor during use | 30% | 24% | 46% | 7 |
| Ability to control the direction the mop head is moving on the floor | 58% | 24% | 18% | 33 |

(A) BONA MICROFIBER CLEANING PAD

Interestingly, Inventive Example 6 delivered these benefits when used with the SWIFFER XL mop device, which has a more flexible joint between the handle and the mop head than the SWIFFER WETJET mop device which was employed in evaluating Inventive Examples 1-4. Based on this result, cleaning pads like those of Inventive Examples 1-6 are thought to be suitable for use with relatively heavy or relatively light mop devices and for use with mop devices having a relatively stiff or relatively flexible joint between the handle and the mop head.

The first region 12 may comprise a plurality of spaced apart portions of relatively medium absorbency material 8. The portions may be chevon shaped. The portions may be wavy shaped. The portions may be polygons or rounded shape. The portions may be shaped as squares, rectangles, circles, ovals, and combinations thereof. The first region 12 may comprise a plurality of interconnected portions of relatively medium absorbency material 8. The plurality of interconnected portions. The portions that are interconnected by form a checkered pattern of squares, a checkered pattern of rectangles, a checkered pattern of diamonds, a checkered pattern of circles, a checkered pattern of ovals.

The cleaning pad 1 can be used in a method of cleaning a floor (112) comprising the steps of: providing the cleaning pad 1; engaging the cleaning pad with a mop head of a cleaning device; applying a wetting solution to the floor or to the cleaning pad; and wiping the floor with the cleaning pad. Optionally, the method can further comprise the step of washing the cleaning pad after wiping the floor. The cleaning pad 1 can be used in a method of cleaning a floor (112) comprising the steps of: providing the cleaning pad according to any of the preceding claims; engaging the cleaning pad with a mop head of a cleaning device; and wiping the floor with the cleaning pad; wherein the floor is dry. Optionally, the method can further comprise the step of washing the cleaning pad after wiping the floor.

Figure 14:
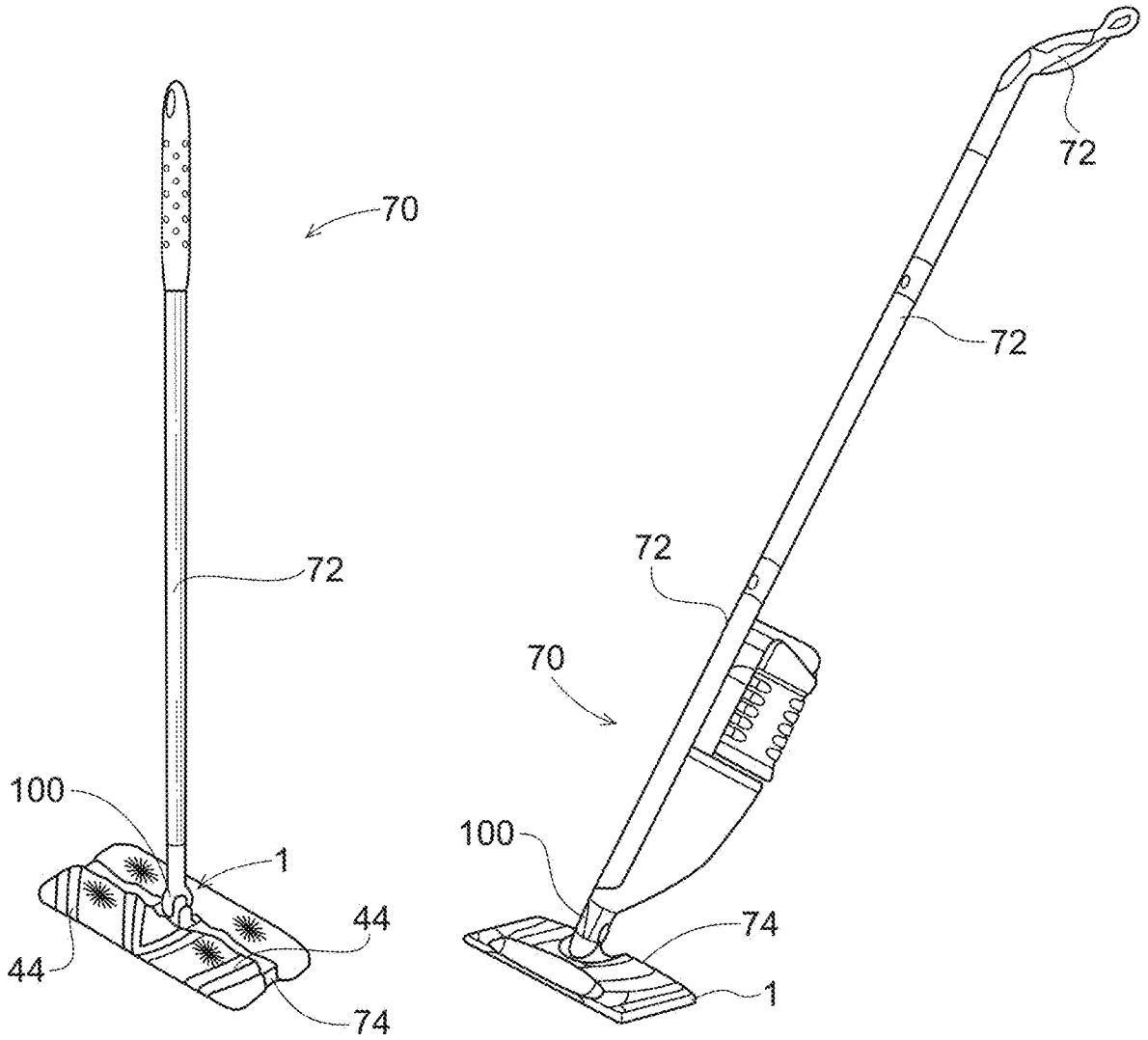
FIG. 14 are mop devices.

Cleaning devices 70 are shown in FIG. 14. The cleaning device 70 can comprise a mop head 74 and a handle 72 extending from the mop head 74. The cleaning pad 1 can be attachable to and detachable from the mop head 74, by way of nonlimiting example via an adhesive or interlocking structure, such as VELCRO. Optionally the cleaning pad 1 can be attachable to and detachable from the mop head 74 by wrapping the wings 44 about the mop head 74. The mop head 74 can be provided with flexible crimping teeth to engage the wings 44 with the mop head, for example as employed in SWIFFER XL SWEEPER, available from the Procter & Gamble Co., Cincinnati, OH. The mop head 74 and the handle 72 can be engaged with one another via a joint 100. The joint 100 can be a hinge joint, ball joint, universal joint, or other kind of joint or combinations of joints.

Combinations:

An example follows:

A. A cleaning pad (1) comprising a floor sheet (2), wherein said floor sheet comprises at least two regions (10) of absorbent materials (11) including a first region (12) comprising a relatively medium absorbency material (8) and a second region (13), wherein said second region comprises one or both of a relatively low absorbency material (7) and a relatively high absorbency material (9), wherein said relatively low absorbency material is 1.1 to 1.35 times less absorbent than said relatively medium absorbency material and said relatively high absorbency material is 1.1 to 1.35 times more absorbent than said relatively medium absorbency material, wherein said first region and said second region together have a combined planar area, wherein said first region comprises from more than 30% to 65% of said combined planar area, wherein said second region comprises from 30% to less than 60% of said combined planar area, wherein said first region and said second region form a substantially coplanar floor engaging surface (19).

B. The cleaning pad according to Paragraph A, wherein one or both of said first region and said second region are continuous.

C. The cleaning pad according to Paragraph A or B, wherein said relatively low absorbency material is 1.15 to 1.3 times less absorbent than said relatively medium absorbency material.

D. The cleaning pad according to any of Paragraphs A to C, wherein said relatively high absorbency material is 1.15 to 1.3 times more absorbent than said relatively medium absorbency material.

E. The cleaning pad according to any of Paragraphs A to D, wherein said relatively low absorbency material is 1.15 to 1.3 times less absorbent than said relatively medium absorbency material, and wherein said relatively high absorbency material is 1.15 to 1.3 times more absorbent than said relatively medium absorbency material.

F. The cleaning pad according to any of Paragraphs A to E, wherein said first region comprises from more than 40% to 60% of said combined planar area.

G. The cleaning pad according to any of Paragraphs A to F, wherein said second region comprises from 35% to less than 50% of said combined planar area.

H. The cleaning pad according to any of Paragraphs A to G, wherein said first region comprises from more than 40% to 60% of said combined planar area and said second region comprises from 35% to less than 50% of said combined planar area.

I. The cleaning pad according to any of Paragraphs A to H, wherein said cleaning pad has a longitudinal axis (L) and comprises:

a front edge (20) and back edge (21) opposite said front edge, wherein said front edge and said back edge cross said longitudinal axis; and a pair of side edges (22) on opposite sides of said longitudinal axis connecting said front edge to said back edge;

wherein said first region comprises at least two spaced apart first region strips (18) extending across said longitudinal axis and said first region strips are separated by at least part of said second region.

J. The cleaning pad according to Paragraph I, wherein said first region strips are chevron shaped.

K. The cleaning pad according to Paragraph I, wherein said first region and said second region form a pattern of interlocking chevron shapes.

L. The cleaning pad according to any of Paragraphs A to K, wherein said cleaning pad has a longitudinal axis (L) and comprises:

a front edge (20) and back edge (21) opposite said front edge, wherein said front edge and said back edge cross said longitudinal axis; and a pair of side edges (22) on opposite sides of said longitudinal axis connecting said front edge to said back edge;

wherein said second region comprises at least two spaced apart second region strips (23) extending across said longitudinal axis and said second region strips are separated by at least part of said first region.

M. The cleaning pad according to Paragraph L, wherein said second region strips are chevron shaped.

N. The cleaning pad according to Paragraph L, wherein said first region and said second region form a pattern of interlocking chevron shapes.

O. The cleaning pad according to any of Paragraphs A to N, wherein said cleaning pad has a longitudinal axis (L) and comprises:

a front edge (20) and back edge (21) opposite said front edge, wherein said front edge and said back edge cross said longitudinal axis; and a pair of side edges (22) on opposite sides of said longitudinal axis connecting said front edge to said back edge;

wherein said first region comprise two spaced apart first region strips (18) extending across said longitudinal axis;

wherein said second region comprises three spaced apart second region strips (23) extending across said longitudinal axis, wherein each said first region strip is between two second region strips.

P. The cleaning pad according to Paragraph O, wherein at least one second region strip is between two first region strips and said at least one second region strip is chevron shaped.

Q. The cleaning pad according to Paragraph O or P, wherein said cleaning pad has a transverse axis (T) perpendicular to said longitudinal axis, wherein one said second region strip comprises said relatively high absorbency material and extends along said transverse axis and two said second region strips are on opposite sides of said transverse axis and comprise said relatively low absorbency material.

R. The cleaning pad according to any of Paragraphs O to Q, wherein said first region comprises more than 40% of said combined surface area, wherein said second region strip comprising said relatively high absorbency material comprises less than 30% of said combined planar area, and wherein said second region strip comprising said relatively low absorbency material comprises less than 30% of said combined planar area.

S. The cleaning pad according to any of Paragraphs A to H, wherein said cleaning pad has a longitudinal axis (L) and comprises:

a front edge (20) and back edge (21) opposite said front edge, wherein said front edge and said back edge cross said longitudinal axis; and a pair of side edges (22) on opposite sides of said longitudinal axis connecting said front edge to said back edge;

wherein said first region comprise three spaced apart first region strips (18) extending across said longitudinal axis;

wherein said second region comprises two spaced apart second region strips (23) extending across said longitudinal axis, wherein each second region strip is between two said first region strips.

T. The cleaning pad according to Paragraph S, wherein said second region strips are chevron shaped.

U. The cleaning pad according to any of Paragraphs A to H, wherein said cleaning pad has a longitudinal axis (L) and a transverse axis (T) perpendicular to said longitudinal axis, wherein said cleaning pad comprises:

a front edge (20) and back edge (21) opposite said front edge, wherein said front edge and said back edge cross said longitudinal axis; and a pair of side edges (22) on opposite sides of said longitudinal axis connecting said front edge to said back edge;

wherein said second region comprises three spaced apart second region strips (23) extending across said longitudinal axis, wherein one of said second region strips extends along said transverse axis;

wherein said first region comprises two first region strips (18) on opposite sides of said transverse axis and separated by said second region strip that extends along said transverse axis;

wherein said first region strips are between two of second region strips.

V. The cleaning pad according to Paragraph U, wherein said first region and said second region form a pattern of interlocking chevrons.

W. The cleaning pad according to any of Paragraphs A to H, wherein said cleaning pad has a longitudinal axis (L) and a transverse axis (T) perpendicular to said longitudinal axis, wherein said cleaning pad comprises:

a front edge (20) and back edge (21) opposite said front edge, wherein said front edge and said back edge cross said longitudinal axis; and a pair of side edges (22) on opposite sides of said longitudinal axis connecting said front edge to said back edge;

wherein said first region comprises three spaced apart first region strips (18) extending across said longitudinal axis, wherein one of said first region strips extends along said transverse axis;

wherein said second region comprises two second region strips (23) on opposite sides of said transverse axis and separated by said first region strip that extends along said transverse axis;

wherein said second region strips are between two of said first region strips.

X. The cleaning pad according to Paragraph W, wherein said first region and said second region form a pattern of interlocking chevrons.

Y. The cleaning pad according to any of Paragraphs A to X, wherein said relatively low absorbency material comprises from 95% to 100% polyester.

Z. The cleaning pad according to any of Paragraphs A to Y, wherein said relatively medium absorbency material comprises a 60:40 to 95:5 polyester:nylon microfiber blend in a twisted loop configuration.

AA. The cleaning pad according to any of Paragraphs A to Z, wherein said relatively high absorbency material comprises an 80:20 to 95:5 polyester:nylon microfiber blend in an untwisted configuration.

BB. The cleaning pad according to any of Paragraphs A to AA, wherein said first region comprises from more than 30% to 60% of said combined planar area, wherein said second region comprises from 30% to less than 60% of said combined planar area, wherein said second region comprises said relatively low absorbency material.

CC. The cleaning pad according to any of Paragraphs A to BB, wherein said first region comprises from more than 30% to 60% of said combined planar area, wherein said second region comprises from 30% to less than 60% of said combined planar area, wherein said second region comprises said relatively high absorbency material.

DD. The cleaning pad according to any of Paragraphs A to CC, wherein said first region comprises from more than 30% to 60% of said combined planar area, wherein said second region comprises from 30% to less than 60% of said combined planar area, wherein said second region comprises from 25% to 35% of said combined planar area of said relatively low absorbency material, wherein said second region further comprises from 25% to 35% of said combined planar area of said relatively high absorbency material.

EE. The cleaning pad according to any of Paragraphs A to DD, wherein said second region comprises both said relatively low absorbency material and said relatively high absorbency material.

FF. A method of cleaning a floor (112) comprising the steps of:

providing the cleaning pad according to any of Paragraphs A to EE;

engaging the cleaning pad with a mop head of a cleaning device;

applying a wetting solution to said floor or to said cleaning pad; and wiping said floor with said cleaning pad.

GG. The method according to Paragraph FF further comprising the step of washing said cleaning pad after wiping said floor.

HH. A method of cleaning a floor (112) comprising the steps of:

providing the cleaning pad according to any of Paragraphs A to EE;

engaging the cleaning pad with a mop head of a cleaning device; and wiping said floor with said cleaning pad;

wherein said floor is dry.

II. The method according to Paragraph HH further comprising the step of washing said cleaning pad after wiping said floor.

JJ. A cleaning pad comprising at least three regions of absorbent materials including a first region comprising a relatively medium absorbency material, a second region comprising a relatively high absorbency material, and a third region comprising a relatively low absorbency material, wherein said relatively low absorbency material is 1.1 to 1.35 times less absorbent than said relatively medium absorbency material and said relatively high absorbency material is 1.1 to 1.35 times more absorbent than said relatively medium absorbency material, wherein said first region, said second region, and said third region have a combined surface area, wherein said first region comprises from 10% to 25% of said combined surface area, and wherein said third region comprises from 25% to 45% of said combined surface area, wherein said first region, said second region, and said third region form a substantially coplanar floor engaging surface.

KK. The cleaning pad according to Paragraph JJ, wherein one or more of said first region, said second region, and said third region are continuous.

LL. The cleaning pad according to Paragraph JJ or KK, wherein said relatively low absorbency material is 1.15 to 1.3 times less absorbent than said relatively medium absorbency material.

MM. The cleaning pad according to any of Paragraphs JJ to LL, wherein said relatively high absorbency material is 1.15 to 1.3 times more absorbent than said relatively medium absorbency material.

NN. The cleaning pad according to any of Paragraphs JJ to MM, wherein said relatively low absorbency material is 1.15 to 1.3 times less absorbent than said relatively medium absorbency material, and wherein said relatively high absorbency material is 1.15 to 1.3 times more absorbent than said relatively medium absorbency material.

OO. The cleaning pad according to any of Paragraphs A to H, wherein said first region comprises from more than 40% to 65%, optionally from more than 40% to 60%, of said combined planar area.

PP. The cleaning pad according to any of Paragraphs A to H, wherein said second region comprises from 30% to less than 50%, optionally from 35% to less than 45% of said combined planar area.

QQ. The cleaning pad according to any of Paragraphs A to H, wherein said first region comprises from more than 40% to 65%, optionally from more than 40% to 60%, of said combined planar area and said second region comprises from 30% to less than 50%, optionally from 35% to less than 45%, of said combined planar area.

RR. The cleaning pad according to any of Paragraphs A to H, wherein said second region comprises from 25% to 35% of said combined planar area of said relatively low absorbency material and said second region further comprises from 25% to 35% of said combined planar area of said relatively high absorbency material.

SS. The cleaning pad according to any of Paragraphs A to H, wherein said second region comprises both said relatively low absorbency material and said relatively high absorbency material.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning pad comprising a floor sheet, wherein said floor sheet comprises at least two regions of absorbent materials including a first region comprising a relatively medium absorbency material and a second region, wherein said second region comprises one or both of a relatively low absorbency material and a relatively high absorbency material, wherein said relatively low absorbency material is 1.1 to 1.25 times less absorbent than said relatively medium absorbency material and said relatively high absorbency material is 1.1 to 1.25 times more absorbent than said relatively medium absorbency material, wherein said first region and said second region together have a combined planar area, wherein said first region comprises from more than 30% to 65% of said combined planar area, wherein said second region comprises from 30% to less than 60% of said combined planar area, wherein said first region and said second region form a substantially coplanar floor engaging surface.

2. The cleaning pad according to claim 1, wherein said relatively low absorbency material is 1.15 to 1.25 times less absorbent than said relatively medium absorbency material.

3. The cleaning pad according to claim 1, wherein said relatively high absorbency material is 1.15 to 1.25 times more absorbent than said relatively medium absorbency material.

4. The cleaning pad according to claim 1, wherein said first region comprises from more than 40% to 60% of said combined planar area.

5. The cleaning pad according to claim 1, wherein said second region comprises from 35% to less than 50% of said combined planar area.

6. The cleaning pad according to claim 1, wherein said cleaning pad has a longitudinal axis and comprises:

a front edge and back edge opposite said front edge, wherein said front edge and said back edge cross said longitudinal axis; and a pair of side edges on opposite sides of said longitudinal axis connecting said front edge to said back edge;

wherein said first region comprises at least two spaced apart first region strips extending across said longitudinal axis and said first region strips are separated by at least part of said second region.

7. The cleaning pad according to claim 6, wherein said first region and said second region form a pattern of interlocking chevron shapes.

8. The cleaning pad according to claim 1, wherein said cleaning pad has a longitudinal axis and comprises:

a front edge and back edge opposite said front edge, wherein said front edge and said back edge cross said longitudinal axis; and a pair of side edges on opposite sides of said longitudinal axis connecting said front edge to said back edge;

wherein said second region comprises at least two spaced apart second region strips extending across said longitudinal axis and said second region strips are separated by at least part of said first region.

9. The cleaning pad according to claim 8, wherein said first region and said second region form a pattern of interlocking chevron shapes.

10. The cleaning pad according to claim 1, wherein said cleaning pad has a longitudinal axis and comprises:

a front edge and back edge opposite said front edge, wherein said front edge and said back edge cross said longitudinal axis; and a pair of side edges on opposite sides of said longitudinal axis connecting said front edge to said back edge;

wherein said first region comprise two spaced apart first region strips extending across said longitudinal axis;

wherein said second region comprises three spaced apart second region strips extending across said longitudinal axis, wherein each said first region strip is between two second region strips.

11. The cleaning pad according to claim 10, wherein at least one second region strip is between two first region strips and said at least one second region strip is chevron shaped.

12. The cleaning pad according to claim 1, wherein said cleaning pad has a longitudinal axis and comprises:

a front edge and back edge opposite said front edge, wherein said front edge and said back edge cross said longitudinal axis; and a pair of side edges on opposite sides of said longitudinal axis connecting said front edge to said back edge;

wherein said first region comprise three spaced apart first region strips extending across said longitudinal axis;

wherein said second region comprises two spaced apart second region strips extending across said longitudinal axis, wherein each second region strip is between two said first region strips.

13. The cleaning pad according to claim 12, wherein said second region strips are chevron shaped.

14. The cleaning pad according to claim 1, wherein said cleaning pad has a longitudinal axis and a transverse axis perpendicular to said longitudinal axis, wherein said cleaning pad comprises:

a front edge and back edge opposite said front edge, wherein said front edge and said back edge cross said longitudinal axis; and a pair of side edges on opposite sides of said longitudinal axis connecting said front edge to said back edge;

wherein said second region comprises three spaced apart second region strips extending across said longitudinal axis, wherein one of said second region strips extends along said transverse axis;

wherein said first region comprises two first region strips on opposite sides of said transverse axis and separated by said second region strip that extends along said transverse axis;

wherein said first region strips are between two of second region strips.

15. The cleaning pad according to claim 14, wherein said first region and said second region form a pattern of interlocking chevrons.

16. The cleaning pad according to claim 1, wherein said cleaning pad has a longitudinal axis and a transverse axis perpendicular to said longitudinal axis, wherein said cleaning pad comprises:

a front edge and back edge opposite said front edge, wherein said front edge and said back edge cross said longitudinal axis; and a pair of side edges on opposite sides of said longitudinal axis connecting said front edge to said back edge;

wherein said first region comprises three spaced apart first region strips extending across said longitudinal axis, wherein one of said first region strips extends along said transverse axis;

wherein said second region comprises two second region strips on opposite sides of said transverse axis and separated by said first region strip that extends along said transverse axis;

wherein said second region strips are between two of said first region strips.

17. The cleaning pad according to claim 1, wherein said first region comprises from more than 30% to 60% of said combined planar area, wherein said second region comprises from 30% to less than 60% of said combined planar area, wherein said second region comprises from 25% to 35% of said combined planar area of said relatively low absorbency material, wherein said second region further comprises from 25% to 35% of said combined planar area of said relatively high absorbency material.

18. The cleaning pad according to claim 1, wherein said second region comprises both said relatively low absorbency material and said relatively high absorbency material.

19. A method of cleaning a floor comprising the steps of:

providing the cleaning pad according to claim 1;

engaging the cleaning pad with a mop head of a cleaning device;

applying a wetting solution to said floor or to said cleaning pad; and wiping said floor with said cleaning pad.

20. A method of cleaning a floor comprising the steps of:

providing the cleaning pad according to claim 1;

engaging the cleaning pad with a mop head of a cleaning device; and wiping said floor with said cleaning pad;

wherein said floor is dry.

* * * * *